US008374531B2

(12) United States Patent
Nakagawa et al.

(10) Patent No.: US 8,374,531 B2
(45) Date of Patent: Feb. 12, 2013

(54) DEVELOPER BEARING MEMBER AND DEVELOPING DEVICE WITH OUTER ELECTRODE INCLUDING SEPARATED PORTIONS, AND INNER ELECTRODE FOR CREATING ELECTRIC FIELD

(75) Inventors: Yoshinori Nakagawa, Yokohama (JP); Hideki Kosugi, Yokohama (JP); Masaaki Yamada, Setagaya-ku (JP); Atsushi Kurokawa, Atsugi (JP); Yasuyuki Ishii, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 566 days.

(21) Appl. No.: 12/633,485

(22) Filed: Dec. 8, 2009

(65) Prior Publication Data

US 2010/0150615 A1 Jun. 17, 2010

(30) Foreign Application Priority Data

Dec. 15, 2008 (JP) ..... 2008-317920
May 20, 2009 (JP) ..... 2009-122038

(51) Int. Cl.
*G03G 15/08* (2006.01)

(52) U.S. Cl. ..... 399/266; 399/265

(58) Field of Classification Search ..... 399/265, 399/258, 270, 271, 281, 285, 286, 291, 293, 399/295, 266
See application file for complete search history.

(56) References Cited

U.S. PATENT DOCUMENTS 5,809,385 A * 9/1998 Snelling et al. ..... 399/266
7,308,222 B2 12/2007 Nakagawa et al.
7,412,190 B2 8/2008 Kadota et al.
7,526,238 B2 4/2009 Yamada et al.
7,554,574 B2 6/2009 Shoji et al.
7,593,657 B2 9/2009 Takahashi et al.
2007/0086811 A1 4/2007 Tsukamoto et al.
2007/0160395 A1 7/2007 Kosugi et al.
2007/0242985 A1 10/2007 Aoki et al.
2008/0089720 A1 4/2008 Tsukamoto et al.
2008/0089723 A1 4/2008 Tsukamoto et al.
2008/0124138 A1 5/2008 Kosugi et al.
2008/0286015 A1 11/2008 Kadota et al.
2009/0016781 A1 1/2009 Takahashi et al.
2009/0022523 A1 1/2009 Kadota et al.

(Continued)

FOREIGN PATENT DOCUMENTS

JP 59-181369 10/1984
JP 1-31611 6/1989

(Continued)

OTHER PUBLICATIONS

Machine English Translation of JP2008-116599 published on May 22, 2008.*

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

An developer bearer conveys developer to a developing station under influence of an electric field created by an electric flux line. The developer bearer includes plural kinds of electrodes that receive different voltages from each other and collectively creates the electric flux line. The plural kinds of electrodes are arranged on different layers in a normal line of the developer bearer. The developer bearer includes an insulation layer that insulates the plural kinds of electrodes.

20 Claims, 16 Drawing Sheets

U.S. PATENT DOCUMENTS

| | | | |
|---|---|---|---|
| 2009/0035025 | A1 | 2/2009 | Ishii et al. |
| 2009/0067879 | A1 | 3/2009 | Takahashi et al. |
| 2009/0067889 | A1 | 3/2009 | Nakagawa et al. |
| 2009/0074431 | A1 | 3/2009 | Aoki et al. |
| 2009/0123193 | A1 | 5/2009 | Kosugi et al. |
| 2009/0257786 | A1 | 10/2009 | Nakagawa et al. |
| 2009/0257791 | A1 | 10/2009 | Nakagawa et al. |
| 2009/0290901 | A1 | 11/2009 | Ishii et al. |

FOREIGN PATENT DOCUMENTS

| | | |
|---|---|---|
| JP | 2002-351218 | 12/2002 |
| JP | 2007-133387 | 5/2007 |
| JP | 2007-133388 | 5/2007 |
| JP | 2008-70751 | 3/2008 |
| JP | 2008-116599 | 5/2008 |
| JP | 2008-122707 | 5/2008 |

* cited by examiner

FIG. 37

【TABLE 1】

| | REGION OPPOSING DEVELOPMENT REGION (Vpp) | REST OF REGION (Vpp) | ISOLATED DOT REPRODUCIBILITY | TONER SCATTER |
|---|---|---|---|---|
| MODIFICATION 11 | 400V | 200V | ○ | ○ |
| COMPARATIVE EXAMPLE 1 | 400V | 400V | ○ | × |
| COMPARATIVE EXAMPLE 2 | 200V | 200V | × | ○ |

DEVELOPER BEARING MEMBER AND DEVELOPING DEVICE WITH OUTER ELECTRODE INCLUDING SEPARATED PORTIONS, AND INNER ELECTRODE FOR CREATING ELECTRIC FIELD

CROSS REFERENCE TO RELATED APPLICATION

This application claims priority under 35 USC §119 to Japanese Patent Application Nos. 2008-317920 and 2009-122038, filed on Dec. 15, 2008, and May 20, 2009, the entire contents of which are herein incorporated by reference

BACKGROUND OF THE INVENTION

1. Field of the Invention

The present invention relates to a developer bearer, a developing device having the developer bearer, and an image forming apparatus having the developing device.

2. Discussion of the Background Art

Conventionally, a developing device including a developer bearer having plural electrodes, to which different voltages are applied, is well known. For example, there exists a developing device that develops a latent image formed on an image bearer, such as a photoconductive member, etc., by supplying developer carried on a developer bearer distanced therefrom. The developing device sometimes employs a system of making one component developer (toner) into a cloud state and supplying it onto a latent image bearer. A developer bearing member employed in the system includes plural kinds of electrodes arranged along an outer circumferential surface thereof at a prescribed pitch and a protection layer overlying such electrodes. When electric fields are created between plural kinds of electrodes neighboring to each other and timely changed by applying different voltages each changing as time elapses to the plural kinds of electrodes, toner on the developer bearing member can soar therebetween due to the electric fields. Such phenomenon is called flare. Thus, the toner becomes the cloud state in the vicinity of the outer circumferential surface of the developer bearing member.

In this system of the developing device, to create the flare while avoiding the toner from attracting to the outer circumferential surface of the developer bearing member, a power relation between a force F1 applied to the toner from a flare use electric field created between the plural kinds of electrodes neighboring to each other and an attraction force F2 attracting the toner to the outer circumferential surface of the developer bearing member becomes important. Specifically, when the F2 is larger than the F1, the toner cannot escape from the attraction force directing to the outer circumferential surface of the developer bearing member, and thus, does not create the flare. Whereas when the F1 is larger than the F2, the toner can create the stable flare in proportion to the difference between these F1 and F2. When the F1 is increased, the above-mentioned difference can also increase, thereby the stable flare can be obtained. To increase the F1, a flare use electric field created on the outer circumferential surface of the developer bearing member is necessarily increased.

The Japanese Patent Application Laid Open No. 2007-133388 discloses a developing device having two kinds of electrodes arranged on the same circumference of a roller state developer bearing member to create a flare electric field. These electrodes are formed in a comb teeth state meshing with each other while being arranged along the outer circumferential surface of the developer bearing member. Then, by applying the above-mentioned voltages to the respective kinds of electrodes, the toner can soar and create the flare between the comb teeth sections.

The Japanese Patent Application Laid Open No. 2008-116599 discloses a roller type developer bearing member having three kinds of electrodes for creating the flare use electric field. Among the three kinds of electrodes, two of those are arranged on the same circumference. The remaining one is arranged on the outer circumferential surface side of the two kinds of electrodes. By applying three different phase voltages to respective electrodes, toner can soar due to the flare created between the respective electrodes.

Further, a developing device described in the Japanese Patent Application Publication No. 1-31611 includes two kinds of electrodes arranged on a developer bearing member for creating an alternating current electric field (charging use electric field) that vibrates and charges toner on the developer bearing member. These two kinds of electrodes are insulated by air provided therebetween. However, a space between these electrodes is not covered with insulation material.

To increase the flare use and charge use electric fields using the developing device in which the plural kinds of electrodes are arranged on the same roller circumference as mentioned in the Japanese Patent Application Laid Open Nos. 2007-133388 and 2008-116599 and Japanese Patent Application Publication No. 1-31611 as above, leakage necessarily occurs and is to be prevented. Since either air or insulation member, such as resin, etc., is filled up between the electrodes, insulation can sufficiently be achieved in deed when relatively small voltages are applied to create an electric field. However, when relatively large voltages are applied to create a larger electric field, the insulation can hardly be sufficiently achieved for the reasons as mentioned below.

In the Japanese Patent Application Laid Open No. 2007-133388, metal plating is applied to the surface of plastic roller having comb teeth sate grooves, and the surface is shaved, thereby two kinds of comb teeth sate electrodes are produced. As another manner of producing such two kinds of comb teeth sate electrodes, the surface of a metal plated roller is etched. Otherwise, conductive ink is ejected using an ink jet system for the same purpose. However, in either case, the insulation between the two kinds of electrodes is achieved by coating and filling up the roller surface with insulation material having comb state electrodes. Thus, a boundary face is formed between two kinds of right and left electrodes and between the lower side resin surface of the roller and the upper side coated insulation material. Thus, leakage likely occurs through the boundary face, and accordingly, the insulation between the electrodes is hardly maintained sufficiently when relatively a large voltage is applied.

Further, as described in the Japanese Patent Application Laid Open No. 2008-116599, among the three kinds of electrodes, two kinds of those are arranged on the same circumference, and two kinds of electrodes are similarly produced as in the Japanese Patent Application Laid Open No. 2007-133388. Accordingly, the leakage likely occurs via a boundary face. Thus, for the same reason as in the Japanese Patent Application Laid Open No. 2008-116599, the insulation between these two electrodes is hardly maintained sufficiently. However, since the insulation layer is arranged between the remaining one kind of the electrode and the two kinds of electrodes among the three, the leakage does not occur therebetween. However, when the leakage occurs between the two kinds of electrodes, an appropriate flare use electric field cannot be created.

Further, in the Japanese Patent Application publication No. 1-31611, since insulation material does not cover a gap between the two kinds of electrodes, leakage necessarily occurs via toner when the toner is filled up between the electrodes.

The above-mentioned leakage necessarily occurs regardless of voltage application in a developer bearing member as far as that includes plural kinds of electrode members which simultaneously receive different voltages from each other.

SUMMARY OF THE INVENTION

The present invention has been made in view of the above noted and another problems and one object of the present invention is to provide a new and noble developing device. Such a new and noble developing device includes plural kinds of electrodes that receive different voltages from each other and collectively creates the electric flux line. The plural kinds of electrodes are arranged at different layers in a normal line of the developer bearer. One of the plural kinds of electrode is located outer side and includes plural electrode portions separated at a prescribed interval on the same circumference of the developer bearer. The other one of plural kinds of electrodes is located inside the outer side electrode opposing plural intervals between plural electrode portions of the outer side electrode. An insulation layer is sandwiched between the plural kinds of electrodes in the normal direction and insulates the plural kinds of electrodes. Plural power distribution device are provided to distribute different powers to the plural electrode members, respectively.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 37 illustrates exemplary evaluations of dot reproducibility and toner scattering performance.

PREFERRED EMBODIMENTS OF THE PRESENT INVENTION

Figure 1:
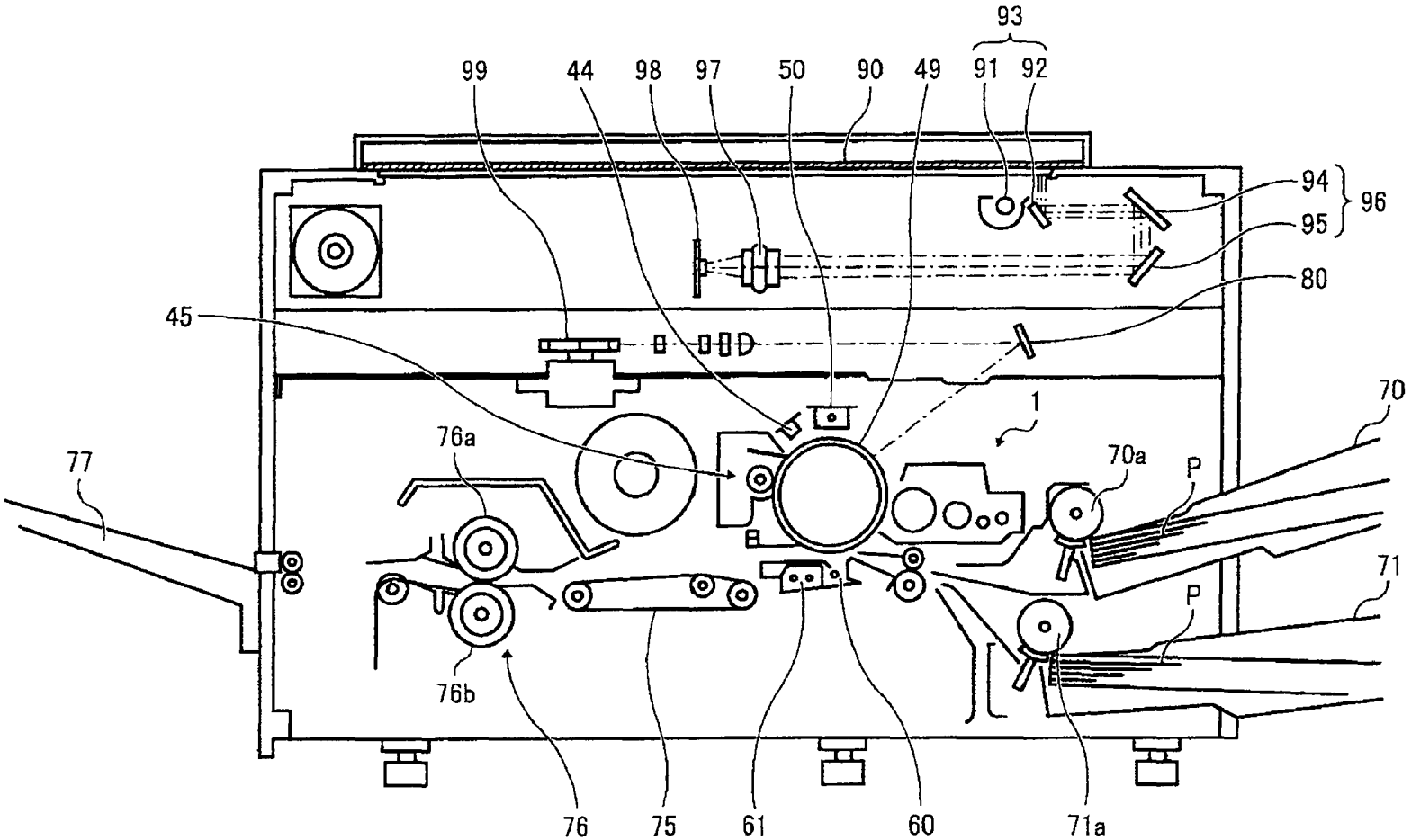
FIG. 1 schematically illustrates an exemplary copier according to one embodiment of the present invention.

Referring now to the drawings, wherein like reference numerals and marks designate identical or corresponding parts throughout several figures, in particular in FIG. 1, an image processing apparatus is described. As shown, a drum state photoconductive member 49 serving as a latent image bearer is driven rotated clockwise. When an operator sets an original document onto a contact glass 90 and depresses a print start switch, not shown, a first scan optical system 93 including an original document illumination light source 91 and a mirror 92, and a second scan optical system 96 including mirrors 94 and 95 move to a prescribed direction and reads the original document. An image of the original document is scanned and read by an image bearer 98 arranged rearward of a lens 97 to become an image signal. The image signal read is converted into a digital state and is then processed. Then, a LD (Laser Diode) is driven by a signal generated by the image processing. A laser light from the laser diode is reflected by a polygon mirror 99 and scans the photoconductive member 49 via the minor 80. Prior to the scanning, a charge device 50 uniformly charges the photoconductive member 49 and a latent image is formed on the surface of the photoconductive member 49 as a result of the scanning of the laser light.

A developing device 1 attracts toner to the latent image on the surface of the photoconductive member 49 in a developing process, thereby a toner image is produced. The toner image is conveyed to a transfer position opposing a transfer charger 60 as the photoconductive member 49 rotates. To the transfer position, either first or second sheet feeding sections 70 or 71 having a first or second sheet feeding roller 70*a* or 71*a*, feeds a printing sheet P in synchronism with the toner image on the photoconductive member 49. Then, the toner image on the photoconductive member 49 is transferred onto the printing sheet P by corona discharge generated by the transfer charger 60.

The printing sheet P having the toner image transferred thereonto is separated by corona discharge executed by the separating charger 61 from the surface of the photoconductive member 49, and is then conveyed toward a fixing device 76 by a conveyance belt 75. Then, the printing sheet P is pinched by a nip formed between a fixing roller 76*a* including a heat source, such as a halogen lamp, etc., not shown, and a pressurizing roller 76*b* pressure contacting the fixing roller 76*a* in the fixing device 76. Then, the toner image is fixed onto the printing sheet P by pressure and heat in the fixing nip and is ejected outside onto a sheet ejection tray 77.

The toner remaining and sticking to the surface of the photoconductive member 49 at down stream of the transfer position is removed by a cleaning device 45 from the surface of the photoconductive member 49. The surface of the photoconductive member 49 thus subjected to the cleaning process is then subjected to a charge removal process of a charge removal lamp 44.

Figure 2:
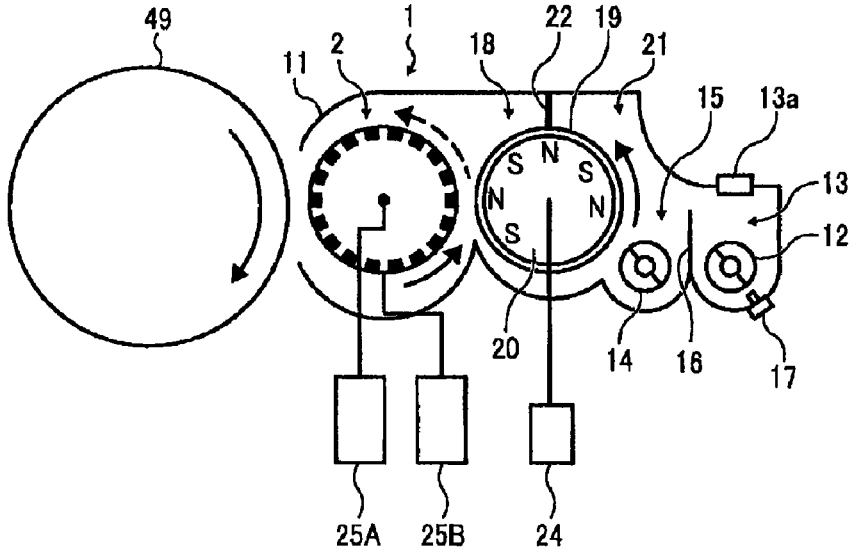
FIG. 2 schematically illustrates an exemplary photoconductive member and a developing device included in the copier.

FIG. 2 illustrates an exemplary photoconductive member 49 and a developing device 1 both included in the copier according to one embodiment of the present invention. A drum state photoconductive member 49 is driven rotated clockwise by a drive device, not shown. A developing device 1 having a toner bearer 49 is driven rotated clockwise by a drive device, not shown. A toner bearing roller 2 serving as a developer bearing member is arranged on the right side of the photoconductive member 49. The developing device 1 includes a first container section 13 that accommodates a first conveyance screw 12 driven rotated clockwise, and a second container section 15 that accommodates a second conveyance screw 14 driven rotated counter clockwise.

These container sections are separated by a partition wall 16 and accommodate admixture of magnetic carrier and toner having negative charge performance, not shown.

The first conveyance screw 12 conveys the admixture in the first container section 13 while stirring thereof from front to rear sides when rotated and driven. At this moment, the admixture on the conveyance is detected by a toner density sensor 17 secured to a bottom of the first container section 13. Then, the admixture conveyed to the vicinity of the rear side end enters the second container section 15 via a first communication opening, not shown, formed in the vicinity of the rear side end of the partition wall 16. The second container section 15 communicates with a magnetic brush forming section 21 that accommodates a toner supplying roller 18 mentioned later as a developer supply member. The second conveyance screw 14 and the toner supplying roller 18 are arranged in parallel opposing to each other via a prescribed gap. The second conveyance screw 14 in the second container section 15 conveys the admixture in the second container section 15 while stirring thereof by its own rotation driving from rear to front sides. During the process, the admixture conveyed by the second conveyance screw 14 is partially lifted up onto a toner supply sleeve 19 included in the toner supplying roller 18. Then, the admixture separates from the surface of the toner supply sleeve 19 after passing through the toner supply position mentioned later and is returned to the second container section 15 again as the toner supply sleeve 19 driven rotates counter clockwise. After that, the admixture conveyed into the vicinity of the front side end by the second conveyance screw 14 is returned to the first container section 13 via a second communication, not shown, arranged in the vicinity of the front side end of the partition wall 16.

The above-mentioned toner density sensor 17 includes a magnetic permeability sensor. A result of detection of magnetic permeability of the admixture by the toner density sensor 17 is transmitted to a control section, not shown, as a voltage signal. Since the magnetic permeability of the admixture correlates to K toner density thereof, the toner density sensor 17 outputs a voltage in accordance with the toner density.

A control section, not shown, of the copier includes a RAM that stores a target value for an output voltage of the toner density sensor 17. Then, by comparing an output voltage from the toner density sensor 17 with a Vref included in the RAM, a toner replenishment device is driven for a time period in accordance with the comparison result. Due to the driving, a prescribed amount of toner is replenished into a first container section 13 via the toner replenishment opening 13*a*, in which the admixture decreases toner density due to consumption of the toner by development. Thus, toner density of the admixture is maintained in the second container section 15 within a prescribed range.

The toner supplying roller 18 includes a cylindrical toner supply sleeve 19 made of non magnetic material driven rotated counter clockwise and a magnetic roller 20 internally secured in the toner supply sleeve 19. The toner supply sleeve 19 is produced by molding a non-magnetic member, such as aluminum, brass, stainless, conductive plastic, etc. The magnetic roller 20 includes plural magnetic poles arranged in a rotational direction (N, S, N, S, N, and S poles arranged counter clockwise in this order from a central position) as shown. These magnetic poles cause the admixture to attract to the surface of the toner supply sleeve 19 and form a magnetic brush including standing ears along magnetic lines.

The admixture lifted up by the surface of the toner supply sleeve 19 rotates counter clockwise as the toner supply sleeve 19 rotates, and enters a bearing amount determining position where a thickness determination member 22 is arranged opposing the surface of the toner supply sleeve 19 via a prescribed gap. At this moment, due to passage through the gap, an amount of the mixture borne on the toner supply sleeve 19 can be determined.

On the left side of the toner supply sleeve 19, the toner bearing roller 2 is driven rotated counter clockwise by a drive device, not shown, while keeping the prescribed gap with the surface of the toner supply sleeve 19. The admixture passing through the bearing amount determining position enters a toner supplying position where the toner bearing roller 2 contacts as the toner supply sleeve 19 rotates. Thus, a leading end of the magnetic brush of the admixture sliding contacts the surface of the toner bearing roller 2. Due to the sliding contact and a difference of a potential between the toner supply sleeve 19 and the toner bearing roller 2, the toner in the magnetic brush is supplied to the surface of the toner bearing roller 2. A supplying bias is applied to the toner supply sleeve 19 from the supply bias power supply 24. Such a supply bias can be one of direct current and alternating current voltages and overlapping of those, as far as it is capable of forming an electric field that can move toner to the side of the toner bearing roller 2.

The admixture on the surface of the toner supply sleeve 19 passing through the toner supply position is conveyed to an opposing position where the second container section 15 opposes as the toner supply sleeve 19 rotates. In the vicinity of the opposing position, none of magnetic poles is arranged in the magnetic roller 20, and accordingly, magnetic force attracting the admixture to the surface of the sleeve does not operate. Thus, the admixture is separated from the surface and returns to the second container section 15. Six magnetic poles are employed in the magnetic roller 20 in this copier. However, the number is not limited thereto, and eight and twelve poles or the like can be used.

The toner bearing roller 2 with the toner supplied is partially exposed from an opening formed on a casing 11 of the development device 1. Such an exposure section opposes the photoconductive member 49 with an interval of from several dozens to few hundred micrometers. In this way, a position where the toner bearing roller 2 and the photoconductive member 49 oppose each other serves as a development position in the copier.

The toner supplied onto the surface of the toner bearing roller 2 is conveyed hopping thereon toward the development position from the toner supply position for the reasons described later. The toner conveyed up to the development region adheres to a latent image section on the surface of the photoconductive member 49 under influence of a development electric field created between the toner bearing roller 2 and the photoconductive member 49 and thereby executing the development. The toner not having contributed to the development is further convened hopping as the toner bearing 2 roller rotates and is repeatedly used.

Figure 3:
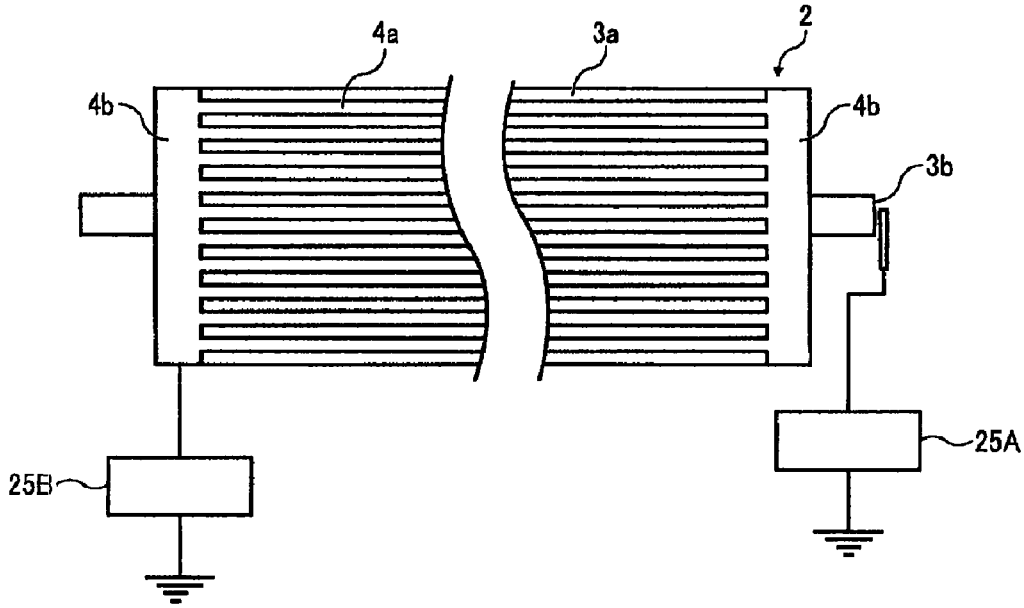
FIG. 3 typically illustrates exemplary electrodes arranged in a toner bearing roller included in the developing device when viewed perpendicular to a rotational axis thereof.

Now, an exemplary toner bearing roller 2 in this embodiment is specifically described with reference to FIGS. 3 and 4, in which a surface layer 6 and an insulation layer 5 are omitted for ease of description. As shown, the toner bearing roller 2 includes a hollow state roller member. The toner bearing roller 2 includes an inner side electrode 3*a* serving as an inner side electrode member or an innermost electrode member positioned innermost, and an outer side electrode 4*a* serving as an outermost electrode member positioned outermost, to which an outer side voltage different from an inner side voltage applied to the inner side electrode 3*a* is applied. Further, an insulation layer 5 is provided between the inner and outer electrodes 3*a* and 4*a* to insulate those. A surface layer 6 covering the outer circumferential surface side of the outer side electrode 4*a* as a protection layer is provided. Specifically, the toner bearing roller 2 includes four layers of the inner side electrode 3*a*, the insulation layer 5, the outer side electrode 4*a*, and the surface layer 6 in this order from the innermost thereof.

The inner side electrode 3*a* function as a substrate of the toner bearing roller 2 and includes a metal roller obtained by molding conductive material, such as SUS, aluminum, etc., in a cylindrical state. The inner side electrode 3*a* can include a resin roller made of material, such as polyathetarl (POM), polycarbonate (PC), etc., and a conductive layer made of a metal layer, such as aluminum, copper, etc., overlying the surface of the resin roller. The conductive layer can be produced by plating metal, applying vapor deposition thereof, or adhering a metal coat to the surface of a roller.

In this embodiment, the outer circumferential surface side of the inner side electrode 3*a* made of polycarbonate, alkyd melamine or the like is covered with the insulation layer 5 preferably having a thickness of from not less than 3 to not more than 50 micrometer. Specifically, when it is less than 3 micrometer, the insulation between inner side and outer side electrodes 3*a* and 4*a* cannot be sufficiently maintained, and leakage likely occurs therebetween. Whereas when it is more than 50 micrometer, an intensive electric field for flare use (i.e., an outer side electric field) created between the inner side and outer side electrodes 3*a* and 4*a* hardly protrudes from the surface layer 6. Then, the thickness of the insulation layer 5 made of melamine resin is about 20 micrometer in this example. The insulation layer 5 is uniformly formed on the inner side electrode 3*a* with a prescribed thickness using a spray or dipping method or the like.

The outer side electrode 4*a* is formed on the insulation layer 5. In this embodiment, the outer side electrode 4*a* is made of metal, such as aluminum, copper, silver, etc. The outer side electrode 4*a* is shaped in a comb teeth state using various manners. For example, either plating or applying vapor disposition onto the insulation layer 5 forms a metal coat, and then applying photo registration etching is executed. Further, an inkjet or screen printing manner is utilized to adhere conductive paste to the insulation layer 5.

The outer circumferential surface side of the outer side electrode 4*a* and the insulation layer 5 are covered with the surface layer 6. The toner is charged by friction when contacting the surface layer 6 and repeatedly hopping thereon. To provide a normal charge polarity (e.g. negative) to the toner, material of the surface layer 6 can include silicone, Nylon™, urethane, alkydmeramine, polycarbonate, etc. This embodiment typically employs the polycarbonate. Since the surface layer 6 also functions to protect the outer side electrode 4*a*, the thickness of the surface layer 6 is preferably from not less than 3 micrometer to not more than 40 micrometer. Specifically, when it is less than 3 micrometer, the outer side electrode 4*a* exposes due to coat as time elapses, and the leakage possibly occurs via toner or members contacting the toner bearing roller 2. Whereas when it is more than 40 micrometer, the electric field created between inner and outer side electrodes 3*a* and 4*a* is hardly exits from the surface layer 6, and the intensive flare is hardly created at the outer side of the surface layer 6. This, the thickness of the surface layer 6 is 20 micrometer in this embodiment. The surface layer 6 can be preferably produced by a spray or dipping manner or the like.

An electric field created between a section of the inner side electrode 3*a* not opposing the outer side electrode 4*a* (i.e., a section of the inner side electrode 3*a* positioned between comb teeth of the outer side electrode 4*a*), and comb teeth sections of the outer side electrode 4*a* extends outside the surface layer 6, so that the toner hops and is clouded on the toner bearing roller 2. At this moment, the toner on the toner bearing roller 2 hops and reciprocates soaring between a section of the surface layer opposing the inner side electrode 3*a* arranged via the insulation layer 5 and that of the surface layer neighboring thereto opposing the outer side electrode 4*a*.

To stably make the toner in the cloud state, it is important for the flare use electric field to have a prescribed intensity. Specifically, a large flare used electric field needs a large potential difference between the inner side and outer side electrodes 3*a* and 4*a*. Thus, it is important to effectively insulate an interval between inner side and outer side electrodes 3*a* and 4*a*, and prevent leakage therebetween. When two kinds of electrodes are each formed in a comb teeth state and are arranged on the same circumference being meshed with each other to create the flare use electric field, but quality of the comb teeth is not fine as in the conventional system, insulation deteriorates and leakage occurs therebetween. Specifically, when the electrode is produced using the etching process, metal coat to be removed possibly partially remains. When an inkjet or screen printing system is used, conductive paste possibly adheres to a section between the electrodes. As a result, the leakage readily occurs between the two kinds of the electrodes and an appropriate flare use electric field is hardly created. Further, in the conventional system, even when the comb teeth sate electrodes is highly precisely produced on the resin surface of the roller in the conventional system, a boundary surface is necessarily formed between the surface of the resin roller and the insulation material between the electrodes, because the two kind of the comb teeth state electrodes are produced, and then the outer circumferential surface side of those is covered with the insulation material to obtain the insulation therebetween. As a result, leakage readily occurs via the boundary surface, and the insulation between the electrodes significantly deteriorates when a relatively large voltage is applied therebetween.

According to this embodiment, since the insulation layer 5 is arranged on the inner side electrode 3*a* and the comb teeth state outer side electrode 4*a* is formed on the insulation layer, the boundary causing the leakage does not exist between the electrodes. Further, conductive material likely causing the leakage rarely intervenes the electrodes in a process of manufacturing the toner bearing roller 2. According to this embodiment, the inner side and outer side electrodes 3*a* and 4*a* can be effectively and stably insulated, so that the leakage can be effectively prevented even when a relatively large voltage is applied.

Further, a width of the electrode of the outer side electrode 4*a* (a width of each of the comb teeth sections) is preferably not less than 10 micrometer to not more than 120 micrometer. Specifically, when it is less than 10 micrometer, the electrode is too thin to avoid the line from being cut off on the way. Where as when it is more than 120 micrometer, a voltage becomes low at a position far from a power distribution section 4*b* of the outer side electrode 4*a*, and toner hardly stably and hops effectively there. As shown in FIG. 3, the power distribution section 4*b* is arranged at both ends on the outer circumferential surface of the toner bearing roller 2 in its axis direction. Further, when the width of the outer side electrode 4*a* is more than 120 micrometer, a flare use electric field is lowered at a center of the toner bearing roller 2 in the axis direction than that at both ends thereof, and accordingly, the toner hardly stably and hops effectively at the center.

Further, a pitch of outer side electrodes 4*a* (a distance between comb teeth sections) is preferably the same or wider than the width of the electrode. Specifically, when it is smaller than the width of the electrode, most of electric flux lines starting from the inner side electrode 3*a* converge at the outer side electrode 4*a* before protruding from the surface layer 6, and thereby the flare use electric field created outside the surface layer 6 becomes weak. Whereas when the pitch of the electrodes is larger, the flare use electric field becomes weak at the center between the electrodes. Thus, the electrode pitch is preferably from not less than the width of the electrode to not more than five times the electrode width. Thus, the width and pitch of the electrodes are each 80 micrometer.

Further, a pitch of the outer side electrode 4*a* is made constant in a circumferential direction of the toner bearing roller 2. Specifically, with the constant pitch, the flare use electric field created between the inner side and outer side electrodes 3*a* and 4*a* can be almost uniform over the circumferential direction of the toner bearing roller 2. Thus, the toner can uniformly hop and develop at the development position in the circumferential direction.

Figure 5:
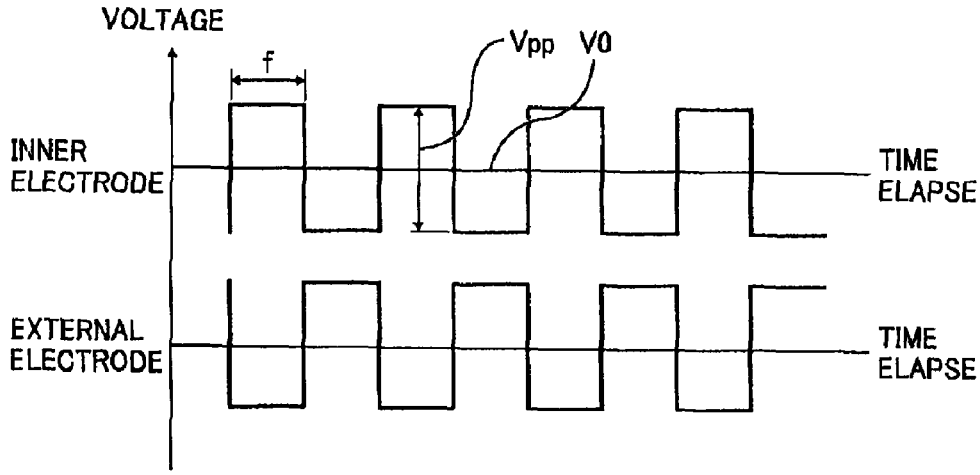
FIG. 5 illustrates exemplary inner and outer side voltages applied to inner and outer side electrodes included in the toner bearing member, respectively.

Now, voltages applied to the inner side and outer side electrodes 3*a* and 4*a* are described with reference to FIG. 5. A pair of pulse power supplies 25A and 25B applies inner and outer side voltages as first and second voltages to the inner and outer side electrodes 3*a* and 4*a*, respectively, on the toner bearing member 2. These inner side and outer side voltages most preferably include rectangular waves. However, a sine wave or a triangle wave can be used. Further, a flare use electrode includes two phase configuration as mentioned by including the inner side and outer side electrodes 3*a* and 4*a*, to which voltages having a phase difference $\pi$ from the other are applied as shown in FIG. 5.

Specifically, as shown, the respective voltages to be applied to those include the rectangular waves having the same amount with a phase difference $\pi$ (Peak to Peak Voltage: Vpp) from the other. Thus, there always exists a difference of the potential Vpp between the inner side and outer side electrodes 3*a* and 4*a*. Due to this potential difference, an electric field is created between the electrodes, and the toner can hop on the surface layer 6 under influence of the flare use electric field generated outside the surface layer 6 among the electric field. The voltage Vpp preferably ranges from not less than 100V to not more than 2000V. Specifically, when the Vpp is less than 100V, the flare use electric field cannot be sufficiently created on the surface layer 6*a*, and the toner cannot readily stably hop thereon. Whereas when the Vpp is more than 2000V, the leakage highly likely occurs between the electrodes as time elapses. Then, the Vpp is set to about 500V. The central value V0 of each of the inner side and outer side voltages is set to a potential between that of an image section (i.e., a potential of a latent image section) and that of non-image section (i.e., a potential of a background section), and is changed in accordance with a development condition.

A frequency of each of the inner side and outer side voltages is preferably from not less than 0.1 kHz to not more than 10 kHz. Specifically, when the frequency is less than 0.1 kHz, hopping of the toner likely cannot catch up a development speed. Whereas when the frequency is more than 10 kHz, movement of the toner cannot follow switching of the electric field, and the toner hardly stably hops. Thus, 500 Hz is preferably used in this embodiment.

Figure 6:
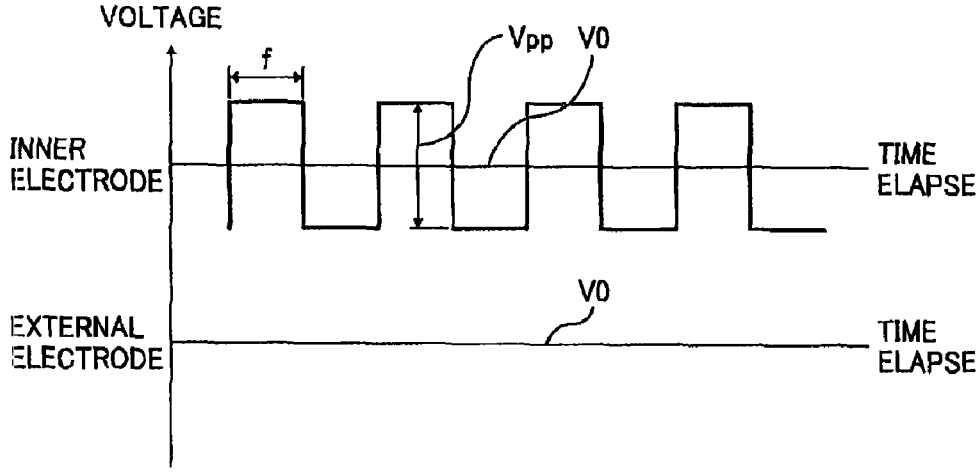
FIG. 6 illustrates another exemplary inner and outer side voltages applied to inner and outer side electrodes, respectively.

Now, the other exemplary inner side and outer side voltages to be applied to the inner side and outer side electrodes 3*a* and 4*a* are described with reference to FIG. 6. As shown, the same inner side voltage is applied to the inner side electrode 3*a*, while a direct current voltage is applied to the outer side electrode 4*a*. Thus, a voltage difference between the electrodes is calculated to be Vpp/2. Thus, the Vpp preferably ranges from not less than 200V to not more than 4000V. Accordingly, a phase difference between the inner side and outer side electrodes 3*a* and 4*a* can be neglected and a power supply cost can be saved.

Figure 7:
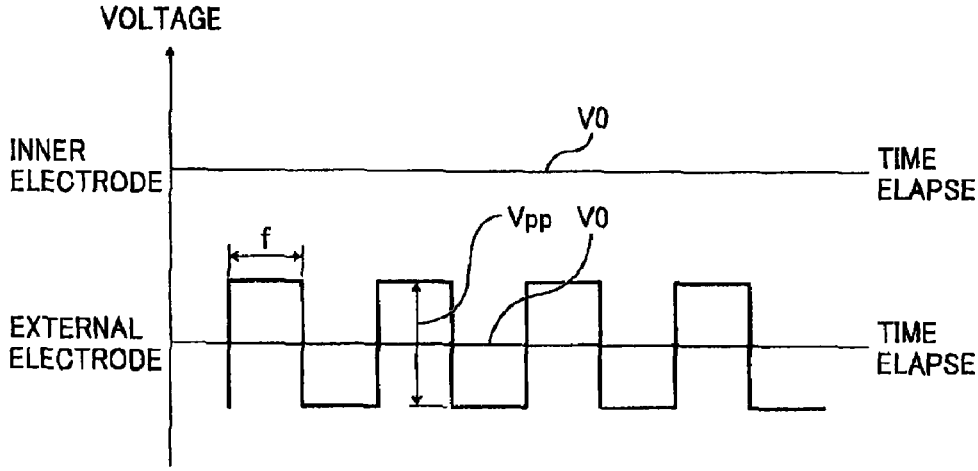
FIG. 7 illustrates still another exemplary inner and outer side voltages applied to inner and outer side electrodes, respectively.

Now, yet the other exemplary inner side and outer side voltages to be applied to the inner side and outer side electrodes 3*a* and 4*a*, respectively, are described with reference to FIG. 7. As shown, the same inner side voltage as in FIG. 5 is applied to the outer side electrode 4*a*, while a direct current is applied to the inner side electrode 3*a*. A voltage difference between the electrodes is calculated to be Vpp/2 as above. The Vpp preferably ranges from not less than 200V to not more than 4000V. According to this embodiment, a phase difference between the inner side and outer side electrodes 3*a* and 4*a* can be neglected and a power supply cost can be saved.

Figure 8:
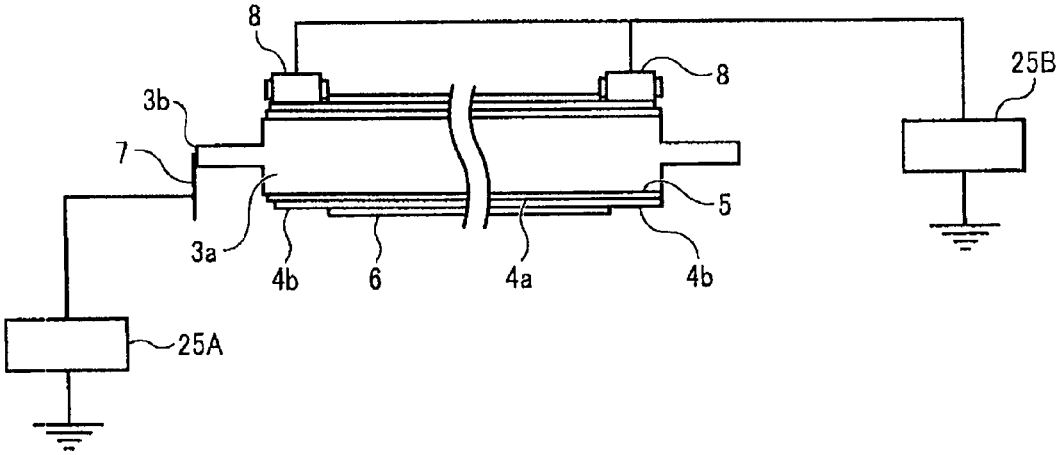
FIG. 8 schematically illustrates an exemplary power distribution system for distributing power to the inner and outer side electrodes when viewed along the roller axis.
Figure 9:
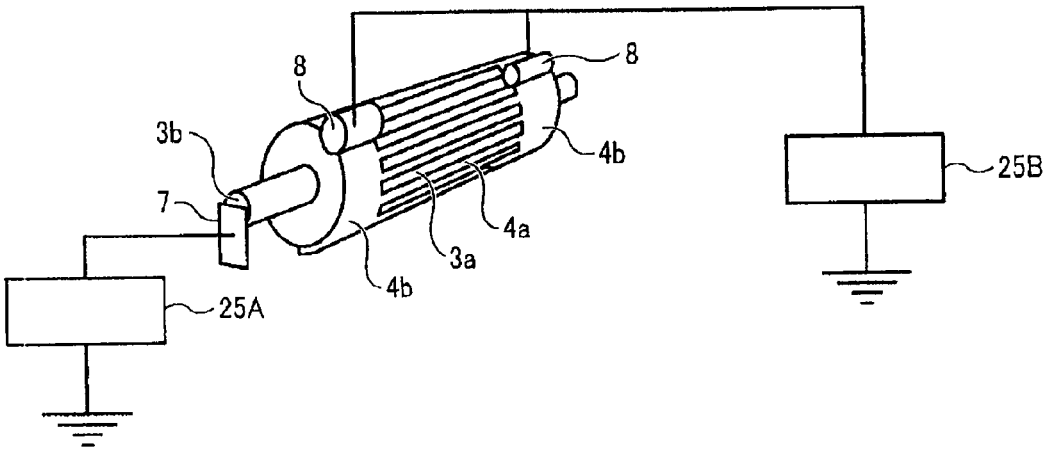
FIG. 9 schematically illustrates a perspective view typically illustrating the power distribution system.

As shown in FIGS. 8 and 9, in the power supply system, the inner side electrode 3*a* is integrated with a roller shaft of the toner bearing roller 2. The roller shaft end surfaces serve as a power distribution sections 3*b*. A power distribution brush 7 connected to a pulse power supply 25A contacts the power distribution section 3*b* as a first power distribution member. Each of the outer circumferential surface of both side ends of the toner bearing roller 2 does not include a surface layer 6, and exposes as a power distribution sections 4*b*. The exposed surfaces are contacted by power distribution rollers 8 serving as a second power distribution member connected to the pulse power supply 25B. Each of the power distribution rollers 8 is freely supported and is driven contacting the power distribution section 4*b* as the toner bearing roller 2 rotates.

In this embodiment, two power distribution rollers 8 are arranged to apply the outer side voltage to the outer side electrode 4*a*. However, one or more than three of the power distribution rollers 8 can be utilized. Specifically, when plurality of second power distribution members are provided and power distribution failure partially occurs due to contact malfunction among the plural second power distribution members, an outer side voltage can be always distributed to the outer side electrode 4*a*.

Further, when a system, in which the outer side electrode 4*a* is partially exposed on the outer circumferential surface of the toner bearing roller 2 to serve as a power distribution section 4*b* and the second power distribution member contact the same to distribute power thereto, the power distribution section 4*b* is expected to position outside a development width on the toner bearing roller 2 in the shaft direction (i.e., a regional width opposing a region in which a latent image is formed on the photoconductive member). That is, when the power distribution section 4*b* positions within the development width, toner crushed between the toner bearing roller 2 and the power distribution section 4*b* disturbs development, and resulting in development failure. More preferably, the power distribution section 4*b* is expected to position outside a toner supply width on the toner bearing roller 2 (i.e., a width in which the toner supply sleeve 19 supplies the toner). That is, when the power distribution section 4*b* positions within the toner supply width, much toner intervenes between the toner bearing roller 2 and the power distribution section 4*b*, thereby readily resulting in development malfunction. Thus, the power-supplied section 4*b* is positioned outside the toner supply width on the toner bearing roller 2 in the shaft direction. Further, to avoid the toner existing within the toner supply width from adhering to the power distribution section 4*b*, toner seals, not shown, are provided on a central side of the respective power distribution sections 4*b* located at both side ends thereof in the shaft direction.

As the second power distribution member, instead of the power distribution roller 8, a conductive brush or plate spring can be used. In such a situation, conductive grease is preferably applied to reduce friction at a contact section where the conductive brush or plate spring contacts the power distribution section 4*b*. Further, as a power distribution section for the inner side electrode 3*a*, a circumferential surface of the roller shaft, and end surfaces of the roller body or the like can be utilized instead of the roller shaft end surface.

Figure 10:
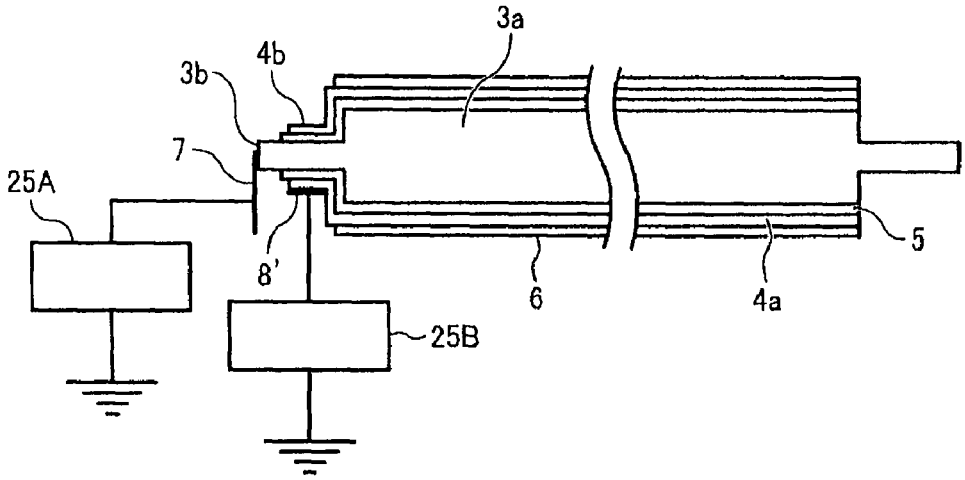
FIG. 10 is a cross sectional view along a roller axis schematically illustrating an exemplary first modification of the power distribution system for distributing power to the inner and outer side electrodes.
Figure 11:
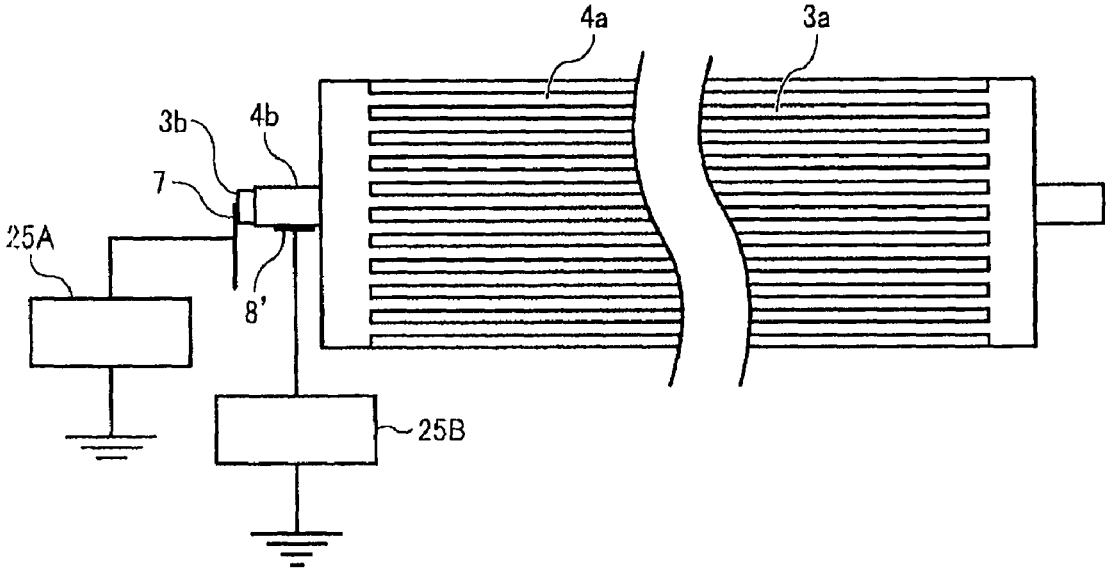
FIG. 11 schematically illustrates the toner bearing roller including the power distribution system when viewed perpendicular to its roller axis.
Figure 12:
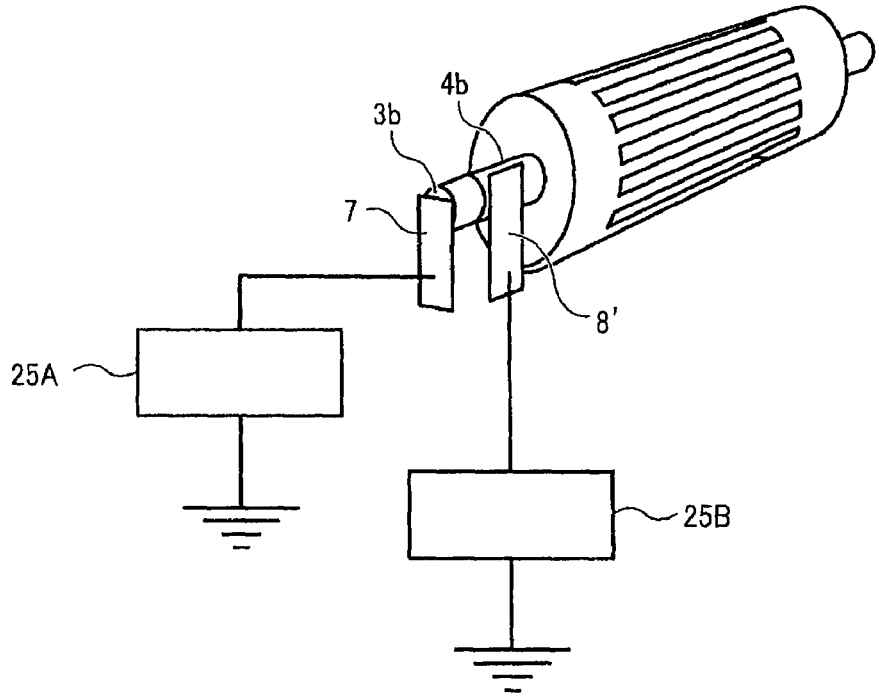
FIG. 12 is a perspective view schematically illustrating the modification of the power distribution system of FIG. 11.

Now, a first modification of a power distribution system for distributing power to the inner side and outer side electrodes 3*a* and 4*a* is described with reference to FIGS. 10 to 12.

As shown, the power distribution system for the inner side electrode 3*a* includes a power distribution section 3*b* on its roller shaft end surface that a power distribution brush 7 contacts as mentioned above. Whereas the power distribution system for the outer side electrode 4*a* includes power distribution sections 4*b* constituted by pulling outer side electrodes 4*a* onto a roller shaft circumference surface. Similarly, the insulation layer 5 is also drawn onto the roller shaft circumferential surface to maintain insulation between the inner side and outer side electrodes 3*a* and 4*a*. To the power distribution section 4*b*, a power distribution brush 8' connected to the pulse power supply 25B contacts as a second power distribution member.

Beside the power distribution system of the first modification, roller shafts of toner bearing rollers 2 can be electrically separately used, and the inner side and outer side electrodes 3*a* and 4*a* are electrically connected to those roller shafts. Then, powers are distributed to the respective inner and outer side electrodes 3*a* and 4*a* via the respective roller shafts.

Figure 13:
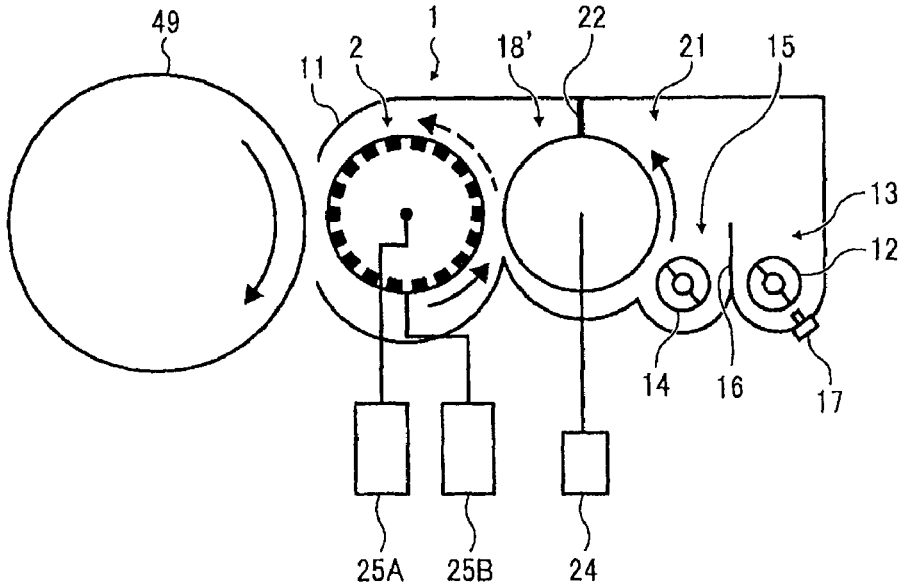
FIG. 13 schematically illustrates a developing device employed in a second modification.

Now, a modification of a system for supplying toner to the toner bearing roller 2 in a development device is described with reference to FIG. 13.

As shown, the toner is supplied to the toner bearing roller 2 excluding magnetic carrier. Specifically, a development device 1 includes a first container section 13 that contains a first conveyance screw 12 driven rotated clockwise and a second container section 14 that contains a second conveyance screw 13 driven rotated counter clockwise. A partition wall 16 separates these container sections. These containers contain toner, not shown, charged in a negative polarity, respectively. The toner is circulated and conveyed through the first and second conveyance sections 13 and 15 as the first and second conveyance screws drive and rotate. During the conveyance, the toner receives sliding contact of the first and second conveyance screws and is charged by friction of those. The toner charged by friction in this way in the second container section 15 electrostatically adheres to a toner supply roller 18' that is provided with a supply bias from the supply bias power supply 24. Such a supply bias can be any one of direct current and alternating current voltages and overlapping of those. The toner adhered to the toner supply roller 18' is flattened to have a prescribed amount by the thickness determination member 22, and is conveyed to the supply position. The toner then receives an influence of a potential difference between the toner supply roller 18' and the toner bearing roller 2 at the supply position and is supplied to the surface of the toner bearing roller 2. After that, the toner is subjected to the same operation as in the first embodiment.

Figure 14:
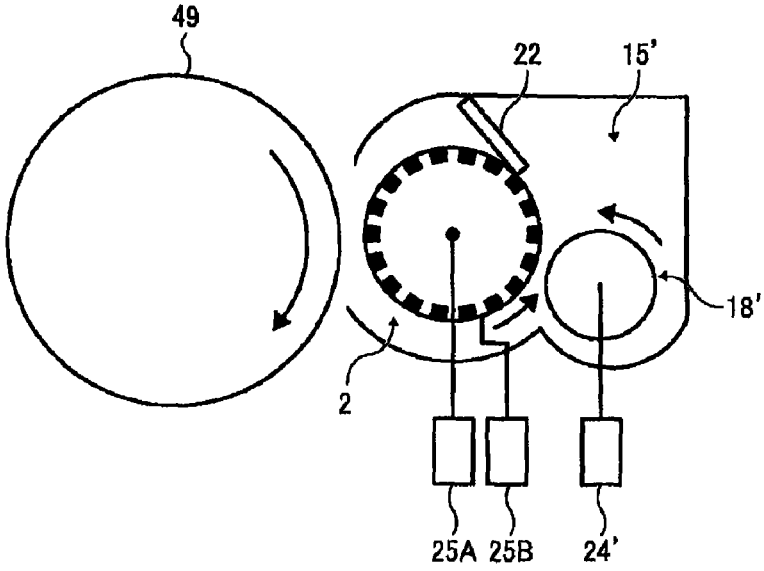
FIG. 14 schematically illustrates a developing device employed in a third modification.

Now, a third modification of a system for supplying toner to the toner bearing roller 2 in a development device is described with reference to FIG. 14.

As shown, the toner is supplied to the toner bearing roller 2 excluding magnetic carrier as in the second modification. However, the toner is directly supplied to the toner bearing roller 2 without using the toner supply roller 18'. Specifically, a sponge roller 18' is arranged contacting a toner bearing roller 2 in the toner container section 15'. Thus, the toner adhering to the surface of the sponge roller 18' in the toner container section 15' receives sliding contact at a contact section contacting the surface of the toner bearing roller 2, and is thereby electro statically supplied to the toner bearing roller 2. Although driving and rotating in the same rotational direction as the toner bearing roller 2, the sponge roller 18' can drive and rotate in a different direction. As shown, an amount of the toner supplied to the toner bearing roller 2 can be controlled by a supply bias applied to the sponge roller 18' from a supply bias power supply 24'. Such a supply bias can be any one of direct current and alternating current voltages and overlapping of those.

Figure 15:
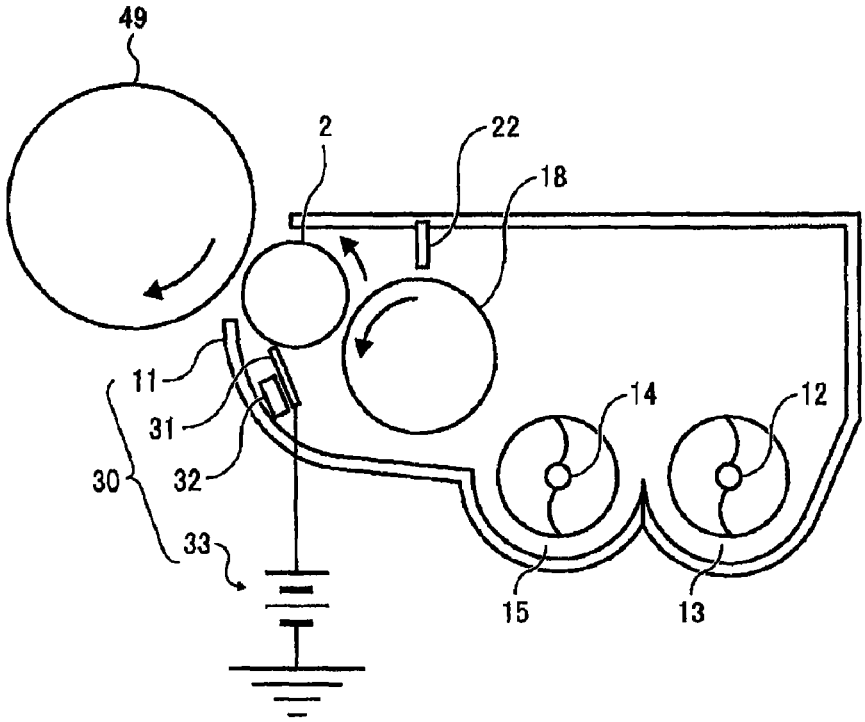
FIG. 15 schematically illustrates a developing device and a photoconductive member employed in a fourth modification.

Now, a fourth modification of the developing device including a collection mechanism as a collection device for collecting toner not having contributed to development from a toner bearing roller 2 is described with reference to FIG. 15. A fundamental configuration of the developing device of this modification is the same as in the above-mentioned embodiment. However, arrangement of a collection mechanism 30 and downward inclination of the inner wall of the casing 11 arranged below all of the toner bearing roller 2 and the toner supplying roller 18 toward the second container section 15 that contains a second conveyance screw 14 are almost different from the above-mentioned embodiment as mentioned below.

As shown, the collection mechanism 30 includes a collection plate 31 arranged opposing the outer circumferential surface of the toner bearing roller 2, a vibration element 32 contacting the collection plate 31, and a collection power supply 33 that applies a prescribed voltage to the collection plate 31. Between the toner bearing roller 2 and the collection plate 31, there is created an electric field that electrostatically moves toner charged with a negative polarity from the toner bearing roller 2 to the collection plate 31. Thus, the toner not having contributed to the development moves from the loner bearing roller 2 to the collection plate 31 in a collection region where the collection plate 31 and the toner bearing roller 2 oppose to each other. The toner adhering to the collection plate 31 drops out from the collection plate 31 when the vibration element 32 vibrates the collection plate 31. The toner dropping out is then moves on the inner wall of the casing 11 and returns to the second container section 15. Then, the toner is circulated and conveyed through the first and second container sections 13 and 15.

Figure 16:
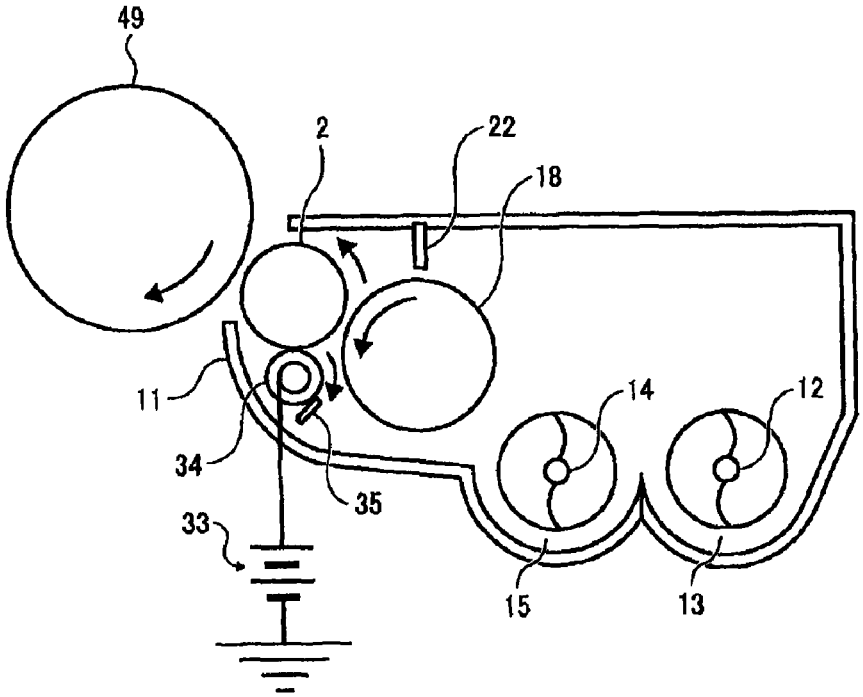
FIG. 16 schematically illustrates an exemplary collecting mechanism included in the developing device.

Now, another configuration of the collection mechanism 30 is described with reference to FIG. 16. As shown, a collection roller 34 can be utilized as a collection mechanism 30. Specifically, the collection mechanism 30 includes a collection roller 34 arranged opposing the outer circumferential surface of the toner bearing roller 2, a cleaning blade 35 contacting the collection roller 34, and a collection power supply 33 that applies a prescribed voltage to the collection roller 34. Between the toner bearing roller 2 and the collection roller 34, there is created an electric field that electrostatically moves the toner charged in a negative polarity from the toner bearing roller 2 to the collection roller 34. Thus, the toner not having contributed to the development moves from the toner bearing roller 2 to the collection roller 34 in a collection region where the collection roller 34 and the toner bearing roller 2 oppose to each other. The toner adhering to the collection roller 34 is scraped off from the collection roller 34 by the cleaning blade 35. The toner scraped off is then moves on the inner wall of the casing 11 and returns to the second container section 15. Then, the toner is circulated and conveyed through the first and second container sections 13 and 15.

Figure 17:
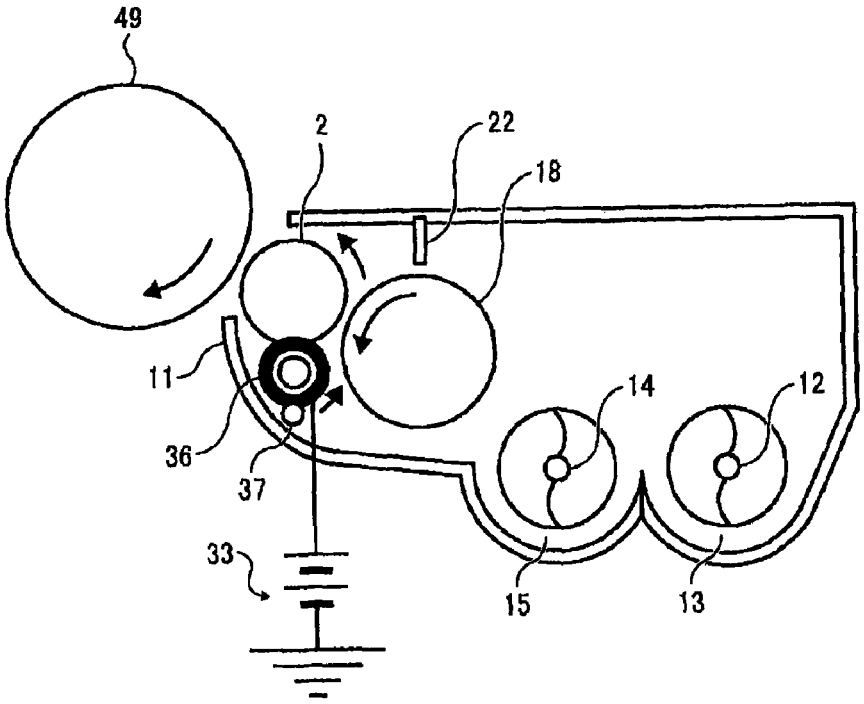
FIG. 17 schematically illustrates another exemplary collecting mechanism included in the developing device.

Now, yet another example of the collection mechanism 30 is described with reference to FIG. 17. As shown, a brush roller 36 is utilized as a collection mechanism 30. Specifically, the collection mechanism 30 includes a brush roller 36 arranged opposing the outer circumferential surface of the toner bearing roller 2, a flicker 37 contacting the brush roller 36, and a collection power supply 33 that applies a prescribed voltage to the brush roller 36. Between the toner bearing roller 2 and the brush roller 36, there is created an electric field that electrostatically moves toner charged in a negative polarity from the toner bearing roller 2 to the brush roller 36. Thus, the toner not contributed to the development moves from the toner bearing roller 2 to the brush roller 36 in a collection region where the brush roller 36 and the toner bearing roller 2 oppose to each other. The flicker 37 drops out the toner adhering to the brush roller 36. The toner dropped out is then moves on the inner wall of the casing 11 and returns to the second container section 15. Then, the toner is circulated and conveyed through the first and second container sections 13 and 15.

Figure 18:
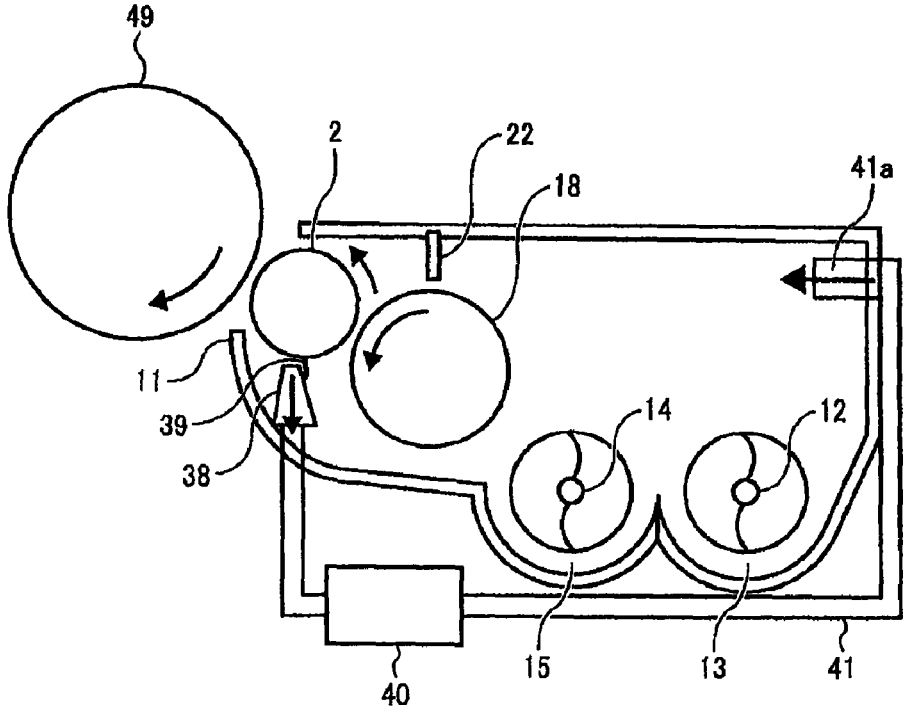
FIG. 18 schematically illustrates yet another exemplary collecting mechanism included in the developing device.

Now, yet another example of the collection mechanism 30 is described with reference to FIG. 18. As shown, a suction pump 40 can be utilized as a collection mechanism 30. Specifically, the collection mechanism 30 includes a suction nozzle 38 arranged opposing the outer circumferential surface of the toner bearing roller 2, a duct 41 connected to the suction nozzle 38 via its inlet end and communicated with the upper section of the first container section 13 that accommodates a first conveyance screw 12 via its outlet end 41*a*, and a suction pump 40 that sucks and conveys toner from the suction nozzle 38 to the outlet end 41*a* of the duct 41. Further, a seal 39 is arranged down stream of the suction nozzle 38 in the surface moving direction of the toner bearing roller 2. The seal 39 contacts the surface of the toner bearing roller 2. Thus, the toner not having contributed to the development is sucked into the suction nozzle 38 riding on air flow caused by the suction pump 40 and returns to the first container section 13 from the outlet end 41*a* passing through the duct 41 in the collection region where the suction nozzle 38 and the toner bearing roller 2 oppose to each other. Then, the toner is circulated and conveyed through the first and second container sections 13 and 15. The toner passing through the collection region not riding on the airflow is stopped by the seal. Thus, such toner is not conveyed down stream as is.

Figure 19:
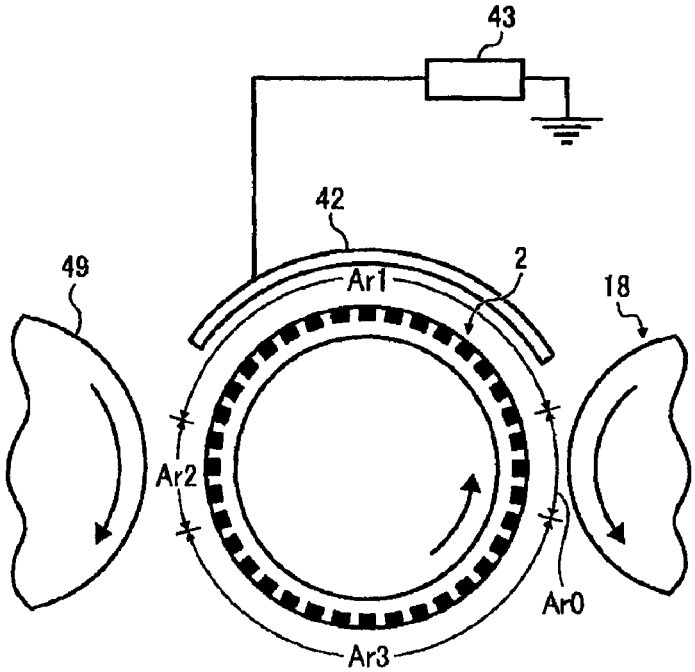
FIG. 19 illustrates an exemplary toner bearing roller and surroundings in the developing device of a fifth modification.

Now, a fifth modification of the developing device including a development section upstream collection device that collects toner sticking to a non-image section on the photoconductive member 49 in a development upstream region is described with reference to FIG. 19. As shown, a region Ar0 represents a toner supply region where the toner bearing roller 2 and a magnetic brush formed on the surface of the toner supply sleeve 19 of the toner supplying roller 18 slide contact each other. A region Ar2 represents a development region. A region Ar1 represents a development section upstream conveyance region located upstream of the development region Ar2 and downstream of the toner supplying roller Ar0 and downstream of the entire region in a surface movement direction of the toner bearing roller 2. A region Ar3 represents a post development conveyance region located upstream of the toner supplying region Ar0 and downstream of the development region Ar2.

The development region Ar2 is considerably neighboring to the toner bearing roller 2 due to curvature of the photoconductive member 49 in the region where the photoconductive member 49 opposes the toner bearing roller 2. A length of the surface movement of the toner bearing roller 2 in such a development region Ar2 can be measured by the following manner. Specifically, a solid image formed on the photoconductive member 49 is developed while behavior of toner in the development region Ar2 and its back and forth vicinage are filmed by a large magnification and high-speed camera. Then, a distance between positions where toner particles adhering to the upstream and downstream ends of the solid image in the photoconductive member surface movement direction lastly hop on the surface of the toner bearing roller 2, respectively, is measured. The distance is then regarded as a length in the roller rotation direction in the developing region Ar2.

Each of pieces of toner hopping in the development section upstream conveyance region Ar1 gradually approaches the development region Ar2 as the toner bearing roller 2 rotates including reversibly charged toner. The reversibly charged toner and normal but too largely charged toner more than an average are included. However, when conveyed to the development region Ar2, these reversibly charged and largely charged toner adhere and cause background stein in a non-image section (i.e., a background) of the photoconductive member 49.

Then, a development section upstream collection device is provided to collect the inversely and largely charged toner among the toner hopping on the surface of the toner bearing roller 2 in the development section upstream conveyance region Ar1. The development section upstream toner collection device includes a development section upstream only opposing electrode 42 opposing the development section upstream conveyance region Art among the entire region over the surface of the toner bearing roller 2 in the rotation direction. A development section upstream collection bias power supply 43 as a voltage supply device is provided to supply a development section upstream collection bias to the development section upstream opposing electrode 42.

The development section upstream opposing electrode 42 at least has a curving surface opposing the toner bearing roller 2 via an almost constant gap from the upstream end to the down stream end thereof in the rotational direction. Such a gap is the same as a development gap as the minimum one defined between the photoconductive member 49 and the toner bearing roller 2 in the developing region Ar2. The development section upstream collection bias power supply 43 outputs a development section upstream opposing bias including a direct current voltage having the same polarity and amount as a background voltage (i.e., a uniformly charged potential) of the photoconductive member 49. Specifically, as a result of application of the development section upstream opposing bias, the voltage of the development section upstream opposing electrode 42 becomes the same polarity and amount as the background voltage on the photoconductive member 49.

The development section upstream toner collection device includes a control section, not shown, for controlling the power supply to output a development section upstream collection bias beside the development section upstream opposing electrode 42 and the development section upstream collection bias power supply 43. During development operation (i.e., when toner capable of contributing to development of a latent image is conveyed in the development section upstream conveyance region Art and the developing region Ar2), the development section upstream collection bias is applied to the development section upstream opposing electrode 42. Thus, among the limitless number of pieces of toner hopping in the development section upstream conveyance region Art, background stein toner adhering and causing background stein on the photoconductive member in the developing region Ar2, i.e., the reversibly and largely charged toner is selectively adhered to the development section upstream opposing electrode 42. Thus, the background stein toner is selectively separated from among the toner conveyed in the development section upstream conveyance region Ar1.

When the developing operation is completed (e.g. a consecutive developing operation when a consecutive printing is selected), the control section switches the voltage output from the development section upstream collection bias power supply 43 from the development section upstream collection bias to an ejection bias larger than the development section upstream collection bias to the side of charge polarity of the toner (e.g. a negative side) using a control signal. Thus, the reversibly and largely charged toner adhered to the development section upstream opposing electrode 42 is separated therefrom and ejected onto the toner bearing roller 2. Then, after passing through both of the developing region Ar2 and the developing section downstream conveyance region Ar3, these pieces of toner are collected into the magnetic brush in the toner supplying region Ar0.

A large alternating current voltage that expands over positive and negative side of a central voltage applied to the electrode of the toner bearing roller 2 is preferably applied as the ejection bias. Thus, a force for reciprocating toner existing between the toner bearing roller 2 and the development section upstream collection bias power supply 43 is applied to the toner, so that the toner can be released from the attraction force of the development section upstream collection bias power supply 43. Thus, the toner on the development upstream section collection bias power supply 43 can be held in a flare use electric field created between the electrodes of the toner bearing roller 2 and efficiently conveyed as the toner bearing roller 2 rotates.

Further, in a system where toner is electrostatically supplied to the toner bearing roller 2 by applying a supply bias to the toner supplying rollers 18 or 18', application of the supply bias to the toner supplying roller 18 or 18' is preferably stopped when reversibly and largely charged toner adhering to the development section upstream opposing electrode 42 is returned to the toner bearing roller 2 by an ejection bias to the development section upstream opposing electrode 42. Specifically, the reversibly and largely charged toner can be returned to the toner-bearing roller 2 having less amount of the attraction toner.

As a manner of removing the reversibly and largely charged toner adhering to the development section upstream opposing electrode 42 therefrom, it is not limited to employ the ejection bias applied thereto. Specifically, a method of scraping off these pieces of toner using a brush roller and that of removing the same by wiping the development section upstream opposing electrode 42 with a removal member having a blade in an axial direction thereof can be employed.

The largely charged toner conveyed in the development section upstream conveyance region Ar1 has relatively larger charge amount than others and hops higher than thereof. When reaching the highest level of hopping, the largely charged toner further rebounds upward from toner cloud formed below including a lot of toner and scatters beyond the electric field created on the toner bearing roller 2. However, since the development section upstream opposing electrode 42 is provided, such scattering can be prevented or suppressed.

As a development section upstream opposing electrode 42, a member produced by coating an insulation layer 5 made of insulation material onto a surface of an electrode (e.g. a surface opposing to a toner bearing roller 2) made of conductive material, such as metal, etc., can be exemplified.

A length of an opposing surface of the development section upstream opposing electrode 42 opposing the toner bearing roller 2 in a direction perpendicular to a roller rotation direction is larger than that of the toner bearing roller. Thus, reversibly and largely charged toner hopping in the development section upstream conveyance region Art can be separated over the entire region of the direction.

Further, a length of an opposing surface of the development section upstream opposing electrode 42 opposing the toner bearing roller 2 in a roller rotation direction is larger than that of the developing region Ar2. Thus, reversibly and largely charged toner generally causing the background stein in the developing region Ar2 can be credibly separated, because these toner are conveyed right below the development section upstream opposing electrode 42 for longer time period than a developing region passage time period as different from when it is shorter than the length of the developing region Ar21 in the roller rotational direction.

Further, a toner hopping condition in a region where the toner bearing roller 2 opposes the development section upstream opposing electrode 42 (hereinafter referred to as a development section upstream conveyance region) among the development section upstream conveyance region Ar1, is the same as that in the developing region Ar2. Thus, reversibly and largely charged toner can precisely be separated and collected while preventing deterioration of the precision thereof, which is caused when the toner hopping condition in the development section upstream conveyance region is different from that in the developing region Ar2. The toner hopping condition can be determined by a combination of a width of an electrode 3*a*, an arrangement pitch of those, a performance of a pulse voltage applied to each of the electrodes, and a thickness of a surface layer 5.

Figure 20:
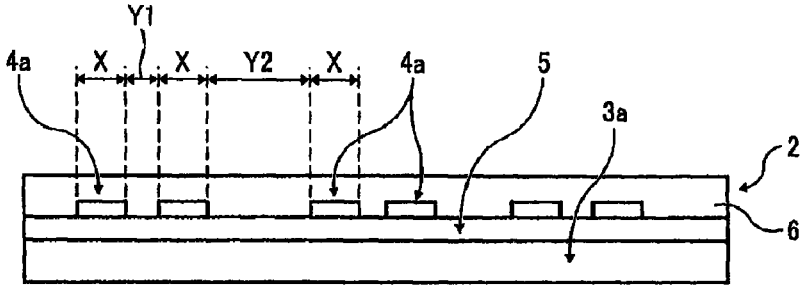
FIG. 20 is a partial cross sectional view when viewed perpendicular to a roller axis, typically illustrating an exemplary toner bearing roller of a sixth modification.

Now, a sixth modification of the outer side electrode 4*a* is described with reference to FIG. 20. Conventionally, to enable most of toner on the outer side electrodes 4*a* to move to any one of two neighboring sections (i.e., sections opposing to the inner side electrodes 3*a* which do not oppose to the outer side electrodes 4*a* (i.e., inner side electrode opposing sections)) between the outer side electrodes 4*a* under influence of the flare use electric field, and to enable most of toner on the inner side electrode opposing sections to move to any one of two outer side electrodes 4*a* neighboring thereto under influence of the flare use electric field, each of widths of the outer side electrode 4*a* and inner side electrode opposing section (i.e., a length in a toner bearing roller surface moving direction) is determined in accordance with intensity of the flare use electric field.

When the widths of the outer side electrode 4*a* and inner side electrode opposing section are equivalent (or slightly different from the other due to manufacturing error), and thus potentials of the inner and outer side electrodes 3*a* and 4*a* are equivalent, a flare use electric field can uniformly be created on the toner bearing roller 2. Thus, unless otherwise the other force than a toner hopping force is applied, the toner can hop on the toner bearing roller 2 being uniformly distributed over the entire outer circumferential surface. However, the potentials of the inner and outer side electrodes 3*a* and 4*a* do not become equivalent or a potential inclination appears in the respective electrodes 3*a* and 4*a* in the surface movement direction of the toner bearing roller 2 due to manufacturing error. As a result, an eccentric flare use electric field is likely created in the direction. In such a situation, the toner hopping on the toner bearing roller 2 disproportionately moves in the surface moving direction of the toner bearing roller 2 while traveling one way along the outer side electrode 4*a* and the inner electrode opposing section in accordance with a potential of the electro flux line. As a result, the toner is largely skewed to a prescribed direction on the toner bearing roller 2 resulting in a large amount of unevenness of the toner at a low frequency.

Further, air flows in the vicinity of the surface of the toner bearing roller 2 and sometimes generates an external force that moves the toner to either an upstream or down stream in the surface moving direction thereof. For example, when the external force that moves the toner to the downstream of the surface moving direction is applied, most of the toner hopping on the toner bearing roller 2 moves in such a direction under influence of all of the flare use electric field and the external force. Thus, the most of toner disproportionately move in the surface moving direction while hopping on the outer side electrode 4*a* and inner side electrode opposing section while traveling one way to the downstream side. As a result, the toner is largely eccentrically located on the toner bearing roller 2 and creates a large amount of unevenness of the toner at a low frequency, thereby causing image density unevenness.

Figure 21:
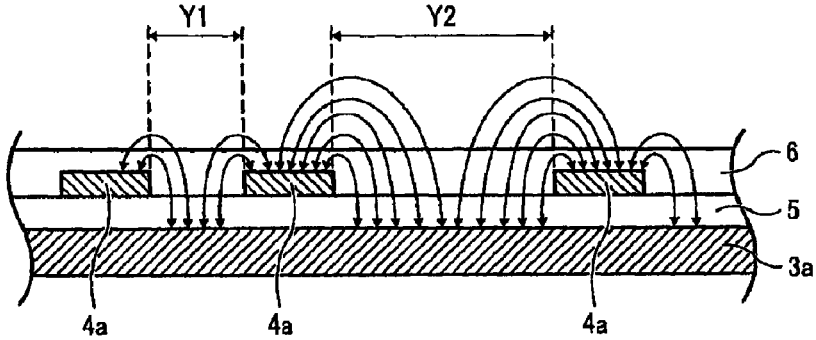
FIG. 21 schematically illustrates exemplary electric flux lines created on the toner bearing roller.

Now, an exemplary electric flux line is described with reference to FIGS. 20 and 21. As shown, a width X of each of the outer side electrodes 4*a* is equally produced in the sixth modification. However, the inner side electrode opposing sections have narrower and wider widths Y1 and Y2 alternately in the surface moving direction. The difference between the widths Y1 and Y2 is larger than a manufacturing error generally caused when the inner side electrode opposing sections are equally produced. Thus, even when a force to move the toner to either upstream or downstream of the surface moving direction is generated due to potential inclination and the airflow or the like, the toner can be prevented from being largely eccentrically located for the reason as mentioned below.

Specifically, when the above-mentioned force occurs, most of the toner hopping on the toner bearing roller 2 tends to move in the surface moving direction, i.e., the direction of the force. As shown in FIG. 21, intensity of each of the flare use electric fields (e.g. electric fields created outside the surface layer 6) created by two inner side electrode opposing sections neighboring to an outer side electrode 4*a* changes in accordance with a width of the inner side electrode opposing section. Specifically, the flare use electric field created between the outside electrode and the inner side electrode opposing section of the wide width Y2 becomes more intensive than that created between that and the inner side electrode opposing sections of the narrow width Y1. The flare use electric field created between the outside electrode and the inner side electrode opposing section of the wide width Y2 becomes more intensive than that created when the width of each of the inner side electrode opposing sections is equivalent as far as voltages applied to the respective inner and outer side electrodes 3*a* and 4*a* are the same. Accordingly, even when the above-mentioned force occurs, lots of toner hopping to the inner side electrode opposing section having the wide width Y2 from the neighboring outer side electrode 4*a* in the direction of the force can be returned to the original outer side electrode 4*a* again. As a result, the toner moved to the inner side electrode opposing section having the wide width Y2 neighboring to the outer side electrode 4*a* in the direction of the force rarely travels one way along the outer side electrode 4*a* and the interval neighboring thereto in the direction of the force.

Thus, the inner side electrode opposing section of the wide width Y2 receives the above-mentioned force and functions as a barrier that impedes the movement of the toner in the direction of the force, so that the toner can be prevented from being largely eccentrically located on the toner bearing roller 2. Thus, a large amount of unevenness of the toner at a low frequency can be suppressed on the toner bearing roller 2, and as a result, uneven image density can be prevented. Since much more toner exits on the outer circumferential surface between inner side electrode opposing section of the wide width Y2 and the outer side electrode 4*a* neighboring thereto in comparison with that exits between inner side electrode opposing section of the narrow width Y1 and the outer side electrode 4*a* neighboring thereto, unevenness of an amount of the toner appears on the toner bearing roller 2 when a broad view is taken. However, since such unevenness is a radio frequency wave state in an extraordinary short cycle and hardly affects image density or is not perceived, image quality does not deteriorate.

The wide width Y2 of the inner side electrode opposing section is preferably from twice to five times the narrow width Y1 thereof. Specifically, when it is less than twice, the flare use electric field created between the outer side electrode and the inner side electrode opposing section having the wide width Y2 is not sufficiently intensive and cannot efficiently serve as the above-mentioned barrier. Thus, unevenness of the image density is not sufficiently suppressed. Whereas when it exceeds five times, since the toner existing at the center of the inner side electrode opposing section of the wide width Y2 cannot move to the outer side electrode 4*a* neighboring thereto, the toner cannot efficiently be made into a cloud state. The narrow width Y1 of the inner side electrode opposing section is preferably almost the same width as the outer side electrode 4*a*. Then, the width of the outer side electrode 4*a* is about 40 micrometer, the narrow width Y1 of the inner side electrode opposing section is about 40 micrometer, and the wide width Y2 thereof is about 120 micrometer.

Heretofore, the width X of each of the outer side electrodes 4*a* is equivalent to the other, while that of the inner electrode opposing sections is not. However, a width X of the outer side electrode 4*a* can be different from others and that of the inner side electrode section ca be equivalent. Because, the same result is obtained. Further, the inner side electrode opposing sections has narrower and wider widths Y1 and Y2 alternately in the surface moving direction of the toner bearing roller 2 as above.

However, such width can be optionally changed. For example, after two consecutive narrower width Y1, one wide width Y2 can exist. Two or more kinds of the widths can be used.

Figure 22:
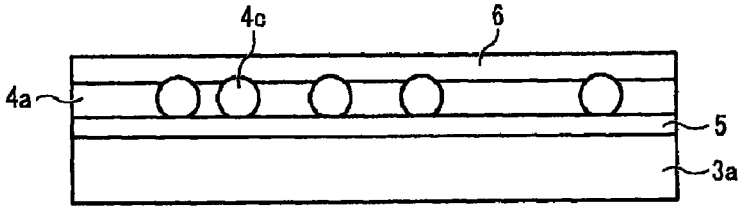
FIG. 22 is a partial cross sectional view in a roller axis direction, typically illustrating an exemplary toner bearing roller of a seventh modification.
Figure 23:
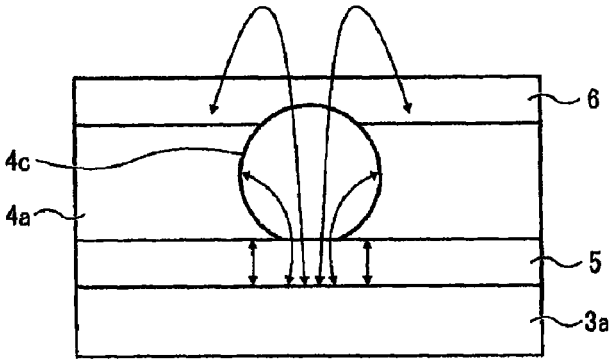
FIG. 23 schematically illustrates exemplary electric flux lines created on the toner bearing roller.

Now, a seventh modification of the outer side electrode 4*a* is described with reference to FIGS. 22 and 23. As shown, after an insulation layer 5 is arranged on the outer circumferential surface side of the inner side electrode 3*a*, an outer side electrode layer mainly made of aluminum, copper, or silver or the like is provided over the insulation layer 5. Specifically, such an outer side electrode layer is produced by dispersing insulation particle 4*c* into one of the aluminum, copper, and silver, or the like, so that the metal section serves as the outer side electrode 4*a*. The average particle of the insulation particle 4*c* is larger than a layer thickness of the outer side electrode. Thus, as shown in FIG. 23, the electric flux lines starting from the inner side electrode 3*a* can exit outside the surface layer 6 via the insulation particle 4*c*, and accordingly, the flare use electric field can be efficiently created outside the surface layer 6. As an insulation particle 4*c*, electrically insulation material of plastic, such as polyester, epoxy, etc., and glass beads or the like can be exemplified. As a manner of forming the outer side electrode layer on the insulation layer 5, a conductive paste with dispersion of insulation particles 4*c* is directly created on the insulation layer 5 using a screen printing for example. A thickness of the outer side electrode layer is preferably from about few micrometer to about several dozens micrometer, and is more preferably about 5 micrometer as employed in this embodiment.

Figure 24:
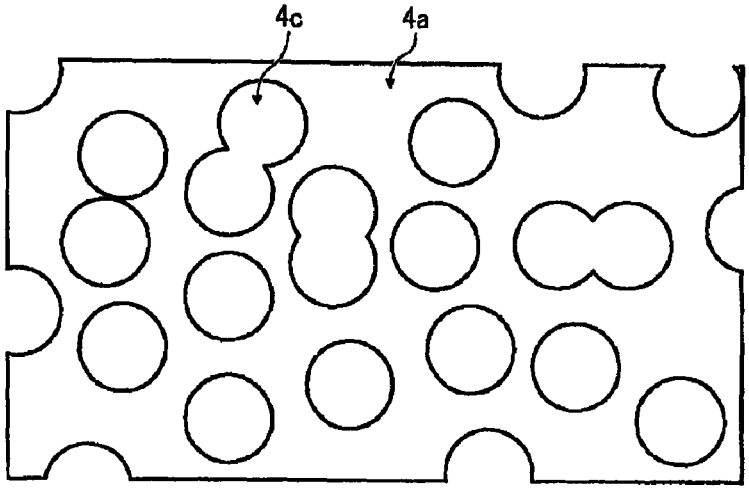
FIG. 24 schematically illustrates an exemplary outer side electrode of the toner bearing roller when viewed from the outer side electrode side.

Further, by changing a cubic ratio of the insulation particle 4*c* in relation to the entire outer side electrode layer as shown in FIG. 24, a surface area of the outer side electrode 4*a* and thereby an intensity of the flare use electric field can be adjusted. Specifically, when the cubic ratio of the insulation particle 4*c* in relation to the entire outer side electrode layer ranges in from 0.2 to 0.8, the toner can be sufficiently clouded. Whereas when the cubic ratio of the insulation particle 4*c* in relation to the entire outer side electrode layer is not less than 0.8, the insulation particle 4*c* occupies almost all of the outer side electrode layer, thereby many float electrodes are produced. Specifically, a voltage applied to the outer side electrode layer goes around the entire outer side electrode layer via the outer side electrode 4*a* not separated by the insulation particle 4*c*. However, when the insulation particle 4*c* occupies almost the entire outer side electrode layer, many sections of the outer side electrodes 4*a* are separated by the insulation particles 4*c* and electrically become a float state. When the cubic ratio is not more than 0.8, the float electrode can exist, but does not affect the flare use electric field if a number thereof is small. Whereas when the cubic ratio not more than 0.2, many electric flux lines starting from the inner side electrode 3*a* converge at the outer side electrode 4*a* before exiting outside the surface layer 6, and accordingly, the flare use electric field becomes weaker at the outside thereof. Then, according to this embodiment, the cubic ratio is about 0.84.

According to the seventh modification, a breadth of the outer side electrode 4*a* and a distance between the insulation particles 4*c* (corresponding to the width of the inner side electrode opposing section in the sixth modification) become uneven. As a result, as similar to the sixth modification, a partially intensive flare use electric field can be locally created and distributed on the toner bearing roller 2. Thus, even when a force to move the toner in a prescribed direction occurs due to the potential inclination or the airflow, the toner can be prevented from being largely eccentrically located on the toner bearing roller 2. In addition, even though only the force created in the surface moving direction of the toner bearing roller 2 can be dealt in the sixth modification, the seventh modification advantageously can additionally handle a force directing to the other direction, such as the axial direction of the toner bearing roller 2, etc.

Figure 25:
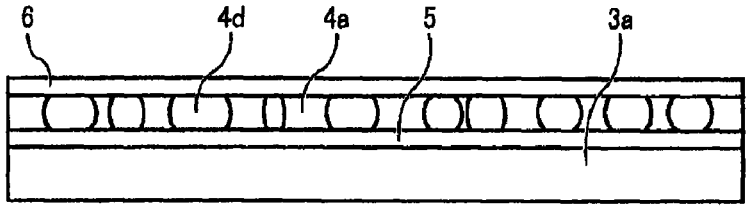
FIG. 25 is a partial cross sectional view in a roller axis direction, typically illustrating an exemplary toner bearing roller of an eighth modification.
Figure 26:
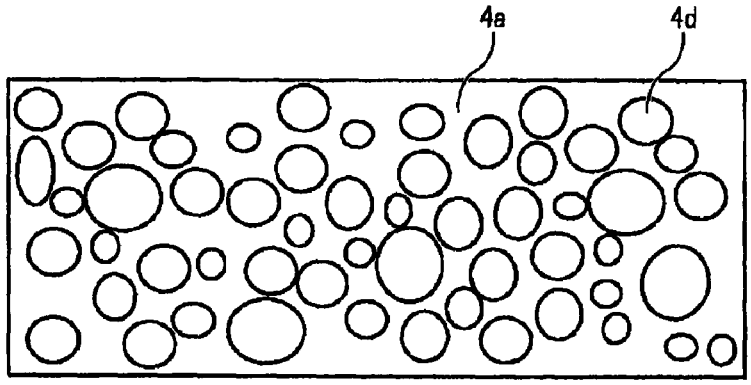
FIG. 26 schematically illustrates an exemplary outer side electrode of the toner bearing roller when viewed from the outer side electrode side.
Figure 27A:
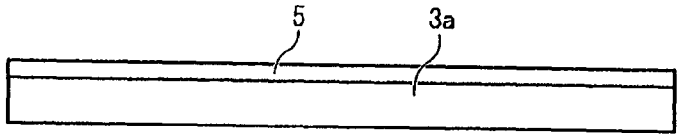
FIGS. 27A to 27C collectively illustrates an exemplary manufacturing sequence manufacturing the toner bearing roller.
Figure 27B:
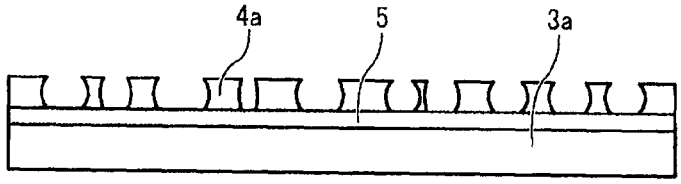
Figure 27C:
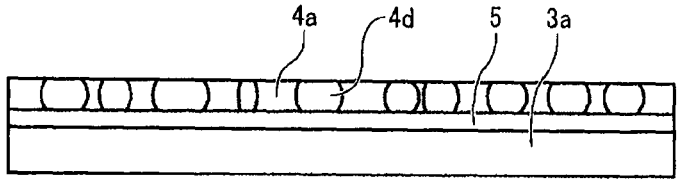

Now, an eighth modification of the outer side electrode 4*a* is described with reference to FIGS. 25 and 26. As shown, and similar to the seventh modification, after an insulation layer 5 is arranged on the outer circumferential surface side of the inner side electrode 3*a* as shown in FIG. 27A, an outer side electrode layer including conductive urethane resin 4*a* and insulation melamine resin 4*a* are provided over the insulation layer 5. Specifically, conductive urethane resin foam raw material is prepared and is poured into a mold. The material is then heated, hardened, and foamed as shown in FIG. 27B. Then, a cell (i.e., a hole) foamed by foaming is coated with the melamine resin using a roller coater as shown in FIG. 27C. Thus, the outer side electrode is formed including conductive urethane resin 4*a* and insulation melamine resin 4*d* dispersed at random on the insulation layer 5. The conductive urethane resin section 4*a* serves as an outer side electrode. Instead of the melamine resin 4*d*, urethane, polyimide, polyamide, Bakelite, polycarbonate, PET, POM, PPE, or the like can be used. A thickness of the outer side electrode layer is preferably from not less than 0.01 to not more than 0.3 mm. Specifically, when it is less than 0.01 mm, precision of the mold cannot be obtained. Whereas when it is more than 0.3 mm, an air layer caused by foaming is blocked up in the outer side electrode layer. Thus, the thickness of the outer side electrode layer of this modification is about 0.1 mm. Further, a diameter of the cell after the foaming is preferably more than the layer thickness of the outer side electrode layer as the insulation particle 4*c* as described in the seventh modification.

According to the eighth modification, a breadth of the conductive urethane resin 4*a* (i.e. the outer side electrode 4*a*) and the melamine resin section 4*d* (corresponding to the inner side electrode opposing section in the sixth modification) similarly become uneven. As a result, as similar to the sixth modification, a partially intensive flare use electric field is locally created and distributed on the toner bearing roller 2. Thus, even when a force to move the toner in a prescribed direction occurs due to the potential inclination or the airflow, the toner can be prevented from being largely eccentrically located on the toner bearing roller 2. In addition, the eighth modification advantageously can handle a force directing to the other direction than the surface moving direction of the toner bearing roller 2, such as the axial direction thereof, etc., as in the seventh modification.

Figure 28:
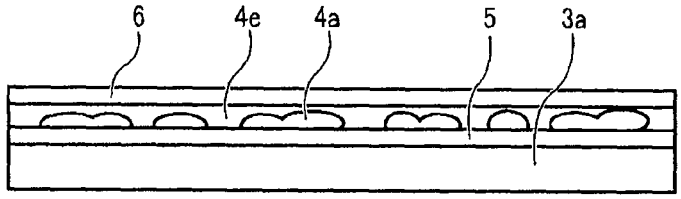
FIG. 28 is a partial cross sectional view in a roller axis direction, typically illustrating an exemplary toner bearing roller of a ninth modification.
Figure 29:
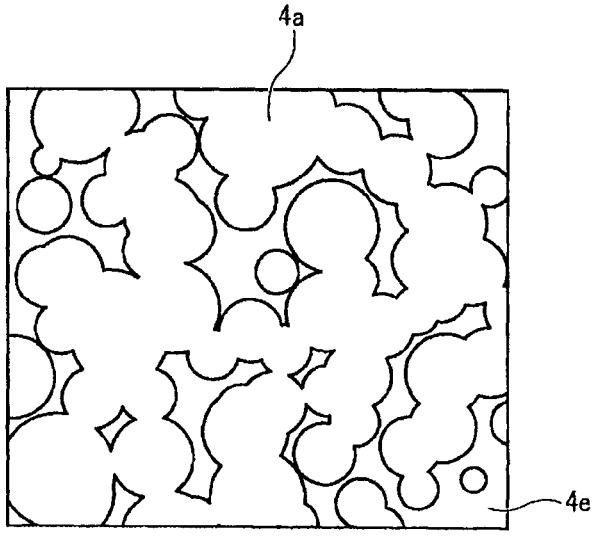
FIG. 29 schematically illustrates an exemplary outer side electrode of the toner bearing roller when viewed from the outer side electrode side.

Now, a ninth modification of the outer side electrode 4*a* is described with reference to FIGS. 28 and 29. As shown, and similar to the seventh and eighth modifications, after an insulation layer 5 is arranged on the outer circumferential surface side of the inner side electrode 3*a*, an outer side electrode layer including resin binder 4*e* and metal filler 4*a* dispersed thereto are provided over the insulation layer 5. The metal fillers 4*a* are fused to each other. Specifically, by spraying and coating paste material that includes resin binder and metal filler dispersed thereto onto an insulation layer 5, an outer side electrode layer is formed in a state such that the metal filler 4*a* is dispersed at random in the resin binder 4*e* on the insulation layer 5. The metal filler section then serves as an outer side electrode. The paste material coated on the insulation layer 5 can employ material obtained by at least dispersing metal particle having more than any one of gold, silver, platinum, palladium, plumbum, tungsten, and nickel or the like into organic resin solvent. Further, as the metal filler 4*a*, metal oxide, such as plumbous, zinc oxide, silicon oxide, boron oxide, aluminum oxide, yttrium oxide, titanium oxide, etc., can be used. As a binder, epoxy resin and phenol resin or the like are preferably used. As the solvent, isopropyl alcohol or the like is used. As a thickening agent, cellulose or the like can be used. About 40 to 60% of binder resin 4*e* is preferably included in the paste material. Specifically, when the binder is too much, since the metal filler is not fused, an electric resistance increases too much. Whereas when the binder is too short, an occupied area for the binder resin 4*e* becomes too narrow, and the flare use electric field to be created outside the surface layer 6 becomes weaker. Thus, about 50% of the binder resin 4*e* is used in this modification. A layer thickness of the outer side electrode layer is preferably from not less than 0.01 to not more than 0.3 mm as in the eighth modification, and 0.1 mm is used in this modification.

Also in this ninth modification, a breadth of the thermal fillers (the outer side electrode) 4*a* and the resin binder 4*e* (corresponding to a width of the inner side electrode opposing section) become uneven. As a result, similar to the sixth to eighth modifications, a partially intensive flare use electric field is locally created and distributed on the toner bearing roller 2. Thus, even when a force to move the toner in a prescribed direction occurs due to the potential inclination or the airflow, the toner can be prevented from being largely eccentrically located on the toner bearing roller 2. In addition, this modification can advantageously handle a force directing to the other direction than the surface moving direction of the toner bearing roller 2, such as an axial direction of the toner bearing roller 2, etc., as in the seventh and eighth modifications.

In the above-mentioned seven to ninth modifications, even though positions of the conductive material section the insulation material section is reversed, the same result can be obtained.

Now, a tenth modification of the outer side electrode 4*a* is described with reference to FIG. 30. In general, when plural kinds of electrode members, such as inner and outer side electrodes 3*a* and 4*a*, are located at different positions from each other in the outer circumferential surface a normal line direction of the toner bearing roller 2 while an insulation layer is laid between the respective electrode members, an electrostatic capacity between the electrode members is larger than that of a system having plural kinds of electrodes on the same roller circumference described in the Japanese Patent Application Laid Open Nos. 2007-133388, 2008-116599, and Japanese Patent Application Publication No. 1-31611. This is mainly because of a difference of an opposing area between the electrode members. Since an alternating current supplied to these electrode members increases in proportion to the electrostatic capacity, a power supply to distribute power to the electrode members needs to provide a large output current when the electrostatic capacity is large therebetween. The alternating current power supply generally is costly in proportion to an amount of the output current. Accordingly, the electrostatic capacity between the electrode members, i.e., that between the inner and outer side electrodes 3*a* and 4*a*, is expected to be as small as possible.

As a method of decreasing the electrostatic capacity between them, an opposing area between the inner and outer side electrodes 3*a* and 4*a* is decreased or a distance therebetween can be is increased. The former method causes a system to be complex and increase manufacturing cost. Whereas, the latter method does not increase the manufacturing cost, because a thickness of the insulation layer intervening between the inner and outer side electrodes 3*a* and 4*a* is increased without complexity. However, since formation of the flare use electric field (i.e., an outer side electric field) at an outside of the surface layer 6 is difficult, thereby a power supply becomes costly. Then, according to this modification, while minimizing the electrostatic capacity between inner and outer side electrodes 3*a* and 4*a* with a simple structure, an intensive flare use electric field is created at the outside of the surface layer 6 with a simple stricture.

Figure 4:
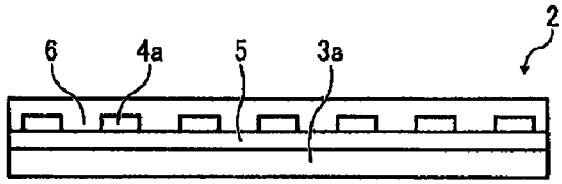
FIG. 4 typically partially illustrates a cross sectional view when viewed in parallel to a plain perpendicular to a rotational axis of the toner bearing roller.
Figure 30:
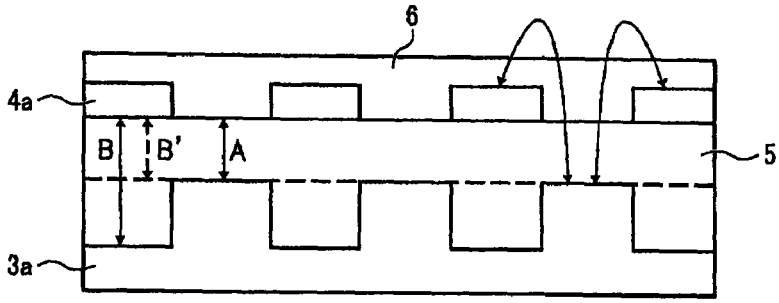
FIG. 30 is a partial cross sectional view in a roller axis direction, typically illustrating an exemplary toner bearing roller of a tenth modification.

As shown in FIG. 30, as a fundamental structure of a toner bearing roller 2, four layers are used as in FIG. 4. However, an inner side electrode 3*a* as a most inner side electrode member has a different structure in the tenth modification. Specifically, an outer circumferential side surface of the inner side electrode 3*a* opposing to an interval between the outer side electrodes 4*a* is located closer to the toner bearing roller's outer circumferential surface than the other surface of the inner side electrode 3*a* that opposes the outer side electrode 4*a*. Thus, a distance B between the outer side electrode 4*a* and the inner side electrode 3*a* opposing the outer side electrode 4*a*, can be longer than that B' in the above-mentioned embodiment. As a result, the electrostatic capacity between the inner and outer side electrodes 3*a* and 4*a* can be more minimized in this modification than the above-mentioned embodiments.

Whereas a section of the inner side electrode 3*a* opposing the interval between the outer side electrodes 4*a* is maintained as in the above-mentioned embodiments. Specifically, the thickness A of the insulation layer existing between the inner side electrode 3*a* and the interval between the outer side electrodes 4*a* is the same. As mentioned above, the flare use electric field protruding from the surface layer 6 is mainly created by the section of the inner side electrode that opposes the interval between the outer side electrodes 4*a* and the outer side electrode 4*a*. Thus, since a positional relation between the section of the inner side electrode 3*a* opposing the interval between the outer side electrodes 4*a* and the outer side electrode 4*a* is the same as in the mentioned embodiment, the intensive flare use electric field having the same level can be created using the same power supply.

As a method of forming the inner side electrode 3*a* of FIG. 30, an outer circumferential surface of a flat inner side electrode opposing the outer side electrodes 4*a* is shaved using a known method, such as photo etching, etc. Specifically, an unevenness pitch of the inner side electrode 3*a* is 160 micrometer, a shaving width is about 80 micrometer, and a shaving depth is about 80 micrometer in this modification.

Figure 31:
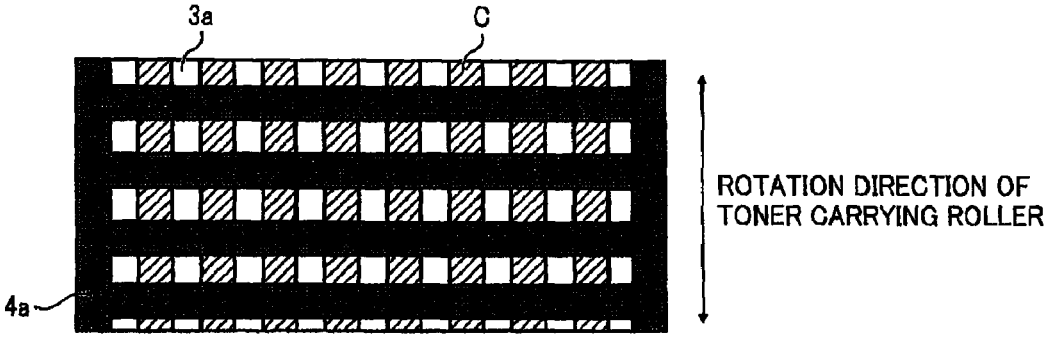
FIG. 31 typically illustrates another exemplary toner bearing roller.

Thus, the inner side electrode 3*a* is shaved along the outer side electrodes 4*a* extending in an axial direction of the toner bearing roller 2, so that the interval between the outer side electrodes 4*a* is separated from the inner side electrode 3*a* opposing thereto over the entire length. However, as far as the inner side electrode 3*a* opposing the interval of the outer side electrodes 4*a* can be partially deleted, so that the electrostatic capacity between the inner and outer side electrodes 3*a* and 4*a* is more decreased. Thus, as shown in FIG. 31 by a reference C, the inner side electrode 3*a* can be shaved along the rotational direction of the toner bearing roller 2.

Now, a result of an experiment of measuring electrostatic capacity when a distance B between the outer side electrode 4*a* and the inner side electrode 3*a* is changed is described. Examples are prepared by deleting the inner electrode 3*a* to have distances B of 15 and 20 micrometer, respectively, and their electrostatic capacities are measured by comparing with a comparative example of a toner bearing roller of FIG. 4, which includes an inner side electrode 3*a* unshaved and an insulation layer with a thickness of 10 micrometer. As a result, it is revealed that an electrostatic capacity of the first example is 80% of the comparative one, while the second example 70% thereof, respectively.

Figure 32:
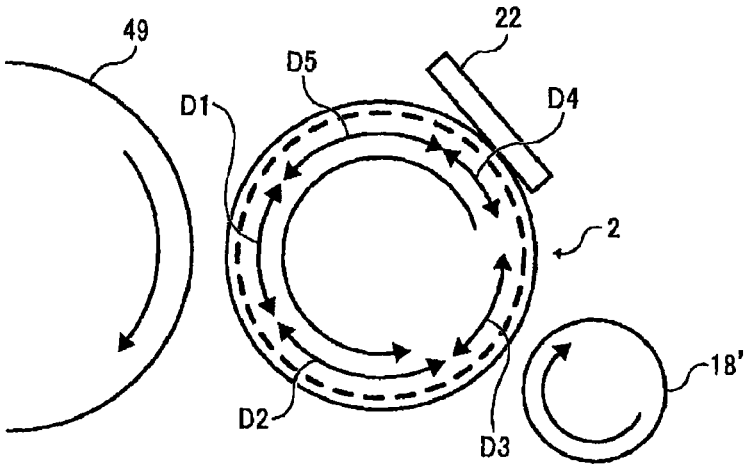
FIG. 32 typically illustrates exemplary regions separated in a rotational direction of a toner bearing roller in an eleventh modification.

Now, an eleventh modification of the power distribution system that distributes power to the inner and outer side electrodes 3*a* and 4*a* is described with reference to FIG. 32. A developing device employed in this modification is fundamentally the same but a power distribution system is different from that in the embodiment of FIG. 14.

As shown, when clouding toner develops a dot latent image formed on the photoconductive member 49, a section formed by isolated dots has an electrostatic force weaker than that created by neighboring plural dots. Thus, to credibly adhere the toner to the isolated dots of the latent image section, the toner is demanded to abut the surface of the photoconductive member as closer as possible. Thus, it is important to highly hop the toner in a region opposing the developing region D1.

As shown, the toner is conveyed to a region D1 as the toner bearing roller 2 rotates while hopping on the outer circumferential surface thereof in the conveyance region D5. When the toner highly hops up in the D5, it likely reaches a level where the flare use electric field is weak. In such a situation, the toner cannot be returned to the outer circumferential surface of the toner bearing roller 2 and causes toner scatter. Thus, the toner is demanded to hop at a low level not to cause toner scattering in a region such as the conveyance region D5.

The hopping height of the toner on the toner bearing roller 2 can be changed by adjusting a voltage applied to the inner or outer side electrode 3*a* or 4*a*. Specifically, when a voltage Vpp shown in FIGS. 5 to 7 is increased, a difference of a voltage between the inner and outer side electrodes 3*a* and 4*a* neighboring to each other increases. Since the distance between these electrodes is constant, the flare use electric field created between the electrodes increases as the voltage difference increases. Since when the flare use electric field grows, an electric field component in a toner hopping direction, i.e., a normal line direction of the outer circumferential surface of the toner bearing roller 2 also increases, the toner more highly hops up. In contrast, when the Vpp decreases, the hopping height of the toner decreases.

In this way, a desirous hopping height of toner is different in accordance with a region in the rotation direction on the outer circumferential surface of the toner bearing roller. Thus, when the hopping height is constant over the entire rotation direction thereon, and it is controlled such that the toner highly hops there so that the isolation dot latent image is appropriately developed in the region D1, the toner scatters in the conveyance region D5. Whereas when it is controlled such the toner hops lower and does not scatters in the conveyance region D5, the isolation dots of the latent image is not appropriately developed in the region D1. Specifically, when the toner hopping height is constant over the entire rotation direction on the toner bearing roller only to satisfy a demand of a prescribed region, a problem remains in the other region.

Figure 33:
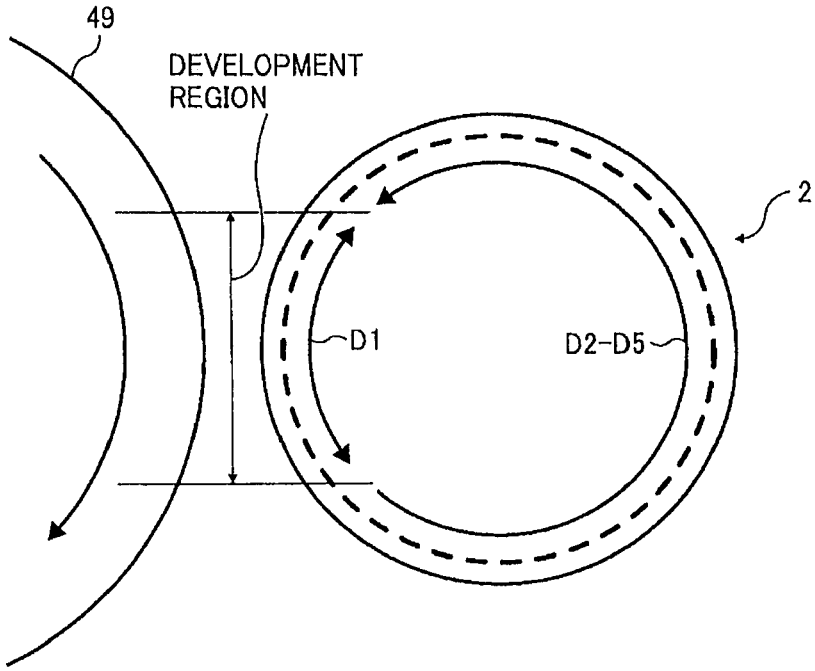
FIG. 33 typically illustrates each of the regions separated in a rotational direction of the toner bearing roller in the eleventh modification.

An optimum hopping height is determined per region, such as a developing region opposing region D1, a conveyance region D2, a supply region D3, a thickness determination region D4, and a conveyance region D5, etc. In this modification, the flare use electric field is different at least in two regions among the five. Then, powers are separately distributed to inner and outer side electrodes 3*a* and 4*a* corresponding to these two regions. Specifically, as shown in FIG. 33, different powers are distributed to inner and outer side electrodes 3*a* and 4*a* corresponding to these two region groups, respectively, so that the flare use electric fields for the D1 and the other regions D2 to D5 are different from each other.

Figure 34:
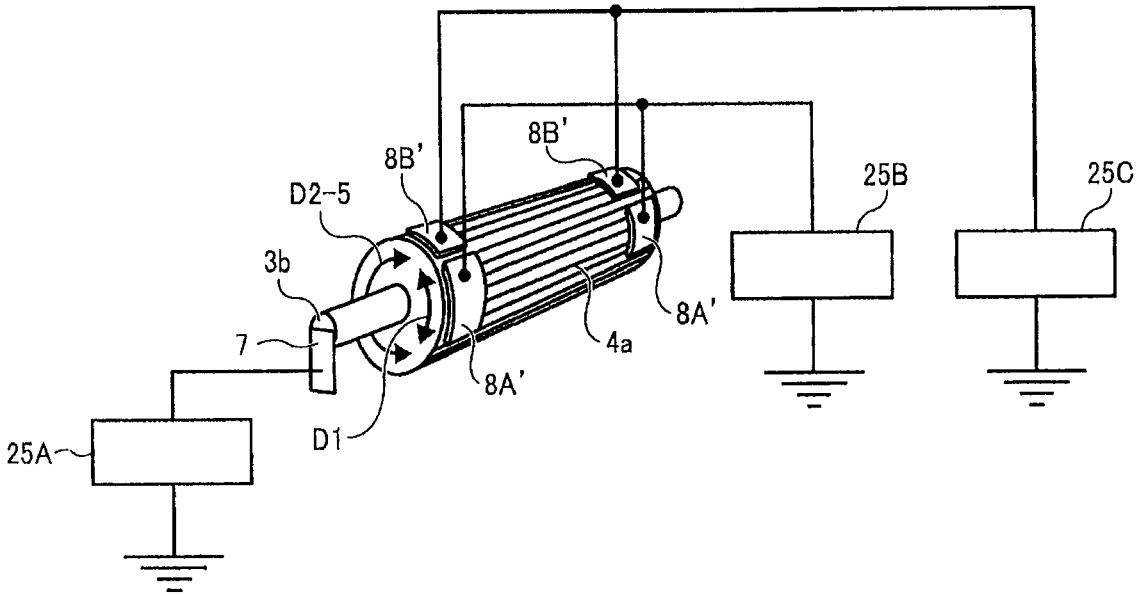
FIG. 34 is a perspective view schematically illustrating an exemplary power distribution system for distributing power to the inner and outer side electrodes.

An exemplary power distribution system for distributing powers to the inner and outer side electrodes 3*a* and 4*a* are described with reference to FIG. 34, which is different from those in FIGS. 8 and 9 as mentioned below. Specifically, this modification newly employs plural power distribution use plate springs 8A' and 8B' for the region D1 and the remaining regions D2 to D5, respectively. Further, respective outer side electrodes 4*a* exposed at both ends of the toner bearing roller 2 are separated so that voltages are applied to respective sections of the outer side electrodes 4*a* from the power distribution use plate springs 8A' and 8B'.

Thus, respective electrode sections of the outer side electrode 4*a* receive power distribution from the first power distribution use plate spring 8A' corresponding to the region D1 when passing through the developing region, and power distribution from the second power distribution use plate spring 8B' when passing through the regions D2 to D5, as the toner bearing roller 2 rotates. A pulse power supply 25B connected to the first power distribution use plate spring 8A' can provide a changeable output voltage. With such configuration, independent from the outer side electrodes 4 located in the remaining regions D2 to D5, a prescribed voltage of power can be distributed to the outer side electrode 4*a* located in the region D1 to form an intensive flare use electric field capable of highly hopping the toner at the region opposing to the developing region so as to appropriately develop an isolated latent image. Also, a pulse power supply 25C connected to the second power distribution use plate spring 8B' corresponding to the regions D2 to D5 can provide a changeable output voltage. Thus, a prescribed voltage of power can be distributed to the outer side electrode 4*a* located in the regions D2 to D5 to form a weak flare use electric field that causes the toner to hops lower and not to scatter there. However, at least one of the pulse power supplies 25B and 25C is preferably capable of changing the output voltage in the above.

As mentioned in this modification, a voltage of power to be distributed to the outer side electrodes 4*a* located in the region D1 is adjusted to be larger than that to be distributed to the outer side electrodes 4*a* located in the regions D2 to D5. Thus, the intensive flare use electric field capable of sufficiently highly hopping the toner and developing isolated latent image can be created in the region D1, while forming the flare use electric field capable of hopping the toner at a lower level avoiding scattering thereof in the regions D2 to D5.

Now, an exemplary result of experiment using the developing device of the eleventh modification as mentioned above is described. As shown, an isolation dot reproducibility and toner scattering appeared on an image formed by the developing device are evaluated. The toner scattering is determined based on a level of contamination on a while sheet. Specifically, the white sheet is laid down right below the toner bearing roller 2. The toner bearing roller 2 is rotated at a line speed of 180 mm/sec for one minute while receiving a voltage similar to when image formation is executed. Then, the level is checked.

Plural comparative developing devices are used in this experiment. One of them includes the developing device of the eleventh modification that applies different voltages to an outer side electrode 4*a* corresponding to the region D1 and an outer side electrodes 4*a* corresponding to the regions D2 to D5. The other includes a developing device that supplies the same voltage to those of the entire regions D1 to D5. A toner bearing roller 2 used therein has a diameter of 30 mm, and width and pitch of inner and outer side electrodes are each 40 micrometer. Each of frequency of inner and outer side voltages applied to the inner and outer side electrodes 3*a* and 4*a* is 1 kHz. Usage toner has an average particle diameter of 5 micrometer. To check isolated dot reproducibility, the toner bearing roller 2 is arranged beside the photoconductive member 49 via a gap of 0.3 mm. The photoconductive member 49 and the toner bearing roller 2 are rotated at the same line speed of 180 mm/sec in the developing region when development is executed. A potential of an image section on the photoconductive member 49 is ±50V, and that of non-image section is ±400V. A developing bias is ±200V that is an average of biases applied to inner and outer side electrodes 3*a* and 4*a*. Resolution is 600 dpi. Evaluation result of the isolation dot reproducibility and toner scattering, as well as voltages applied to the outer side electrodes 4*a* of the regions D1 and D2 to D5 are listed on the table 1.

As shown by the first comparative example, when Vpp 400V is applied to each of the outer side electrodes 4*a* of the D1 to D5, the isolation dot reproducibility is fine while the toner scattering is not, because the toner highly hops on the toner bearing roller 2. Whereas as in the second comparative example, when Vpp 200V is applied, the isolation dot reproducibility is not fine while the toner scattering is fine, because the toner hops low on the toner bearing roller 2. In contrast to these comparative examples, the eleventh modification shows that the isolation dot reproducibility is fine in the region D1 because the toner highly hops on the toner bearing roller 2 there, while the toner scattering is also fine in the remaining regions D2 to D5 because the toner does not highly hops thereon the toner bearing roller 2.

In this modification, to form the flare use electric field, the alternating current voltage is applied to the outside electrode 4*a* of the regions D2 to D5. However, when the toner does not need to hop in the remaining regions D2 to D5, a direct current voltage, such as zero voltage (Vpp), that does not cause the toner to hop, can be applied.

Figure 35:
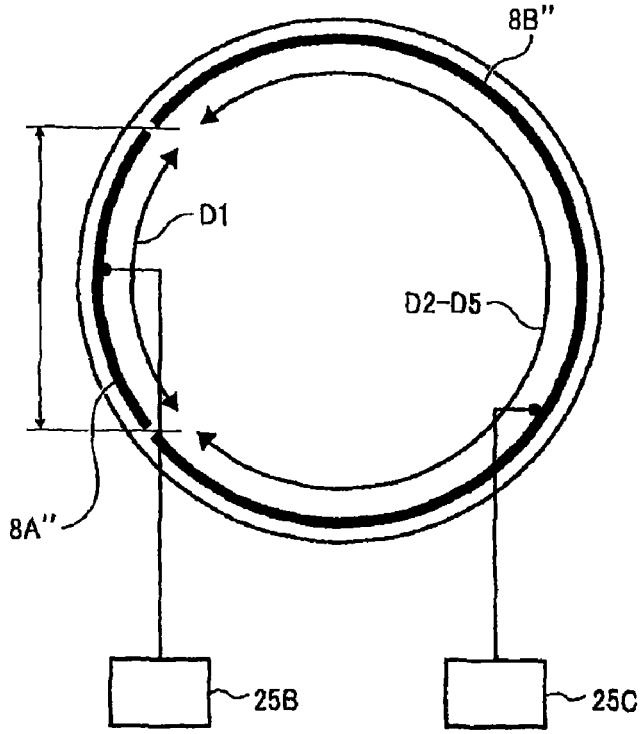
FIG. 35 illustrates the toner bearing roller accommodating two power distribution sections in the eleventh modification.
Figure 36:
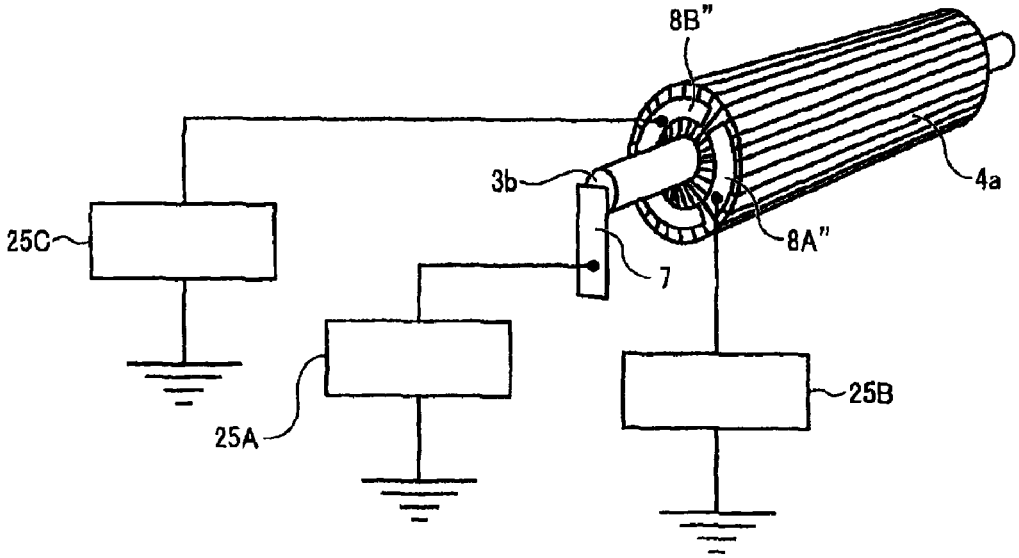
FIG. 36 illustrates another exemplary power supply system employed in the eleventh modification.

Further, the power distribution sections to distribute power to respective outer side electrodes 4*a* of D1 and D2 to D5 are arranged out of the toner bearing roller 2 in this modification. However, one of them can be included in the toner bearing roller 2 as described with reference to FIG. 35. As shown, hollow portions are formed at both axial ends of the toner bearing roller 2. A toner bearing roller inner circumferential surface side of the outer side electrode 4*a* expose to the hollow sections at the both ends to serve as power distribution section sections 4*b*. Further, in the hollow sections, a first electrode plate 8A" is secured at a position opposing the region D1, while a second electrode plate 8B" is secured at a position corresponding to the remaining regions D2 to D5. Thus, each of the electrode section of the outer side electrode 4*a* on the toner bearing roller 2 contacts and receives power distribution from the first electrode plate 8A" when passing through the region D1, while contacting and receiving power distribution from the second electrode plate 8B" when passing through the regions D2 to D5 as the toner bearing roller 2 rotates. Otherwise, as shown in FIG. 36, one of outer side electrodes 4*a* corresponding to the regions D1 and D2 to D5 can be pulled out to a roller end surface of the toner bearing roller 2 to serve as a power distribution section 4*b*.

ADVANTAGE

According to one embodiment of the present invention, since all type of electrode members arranged on the developer bearing member are divided by insulation layers, neither boundary surfaces connecting the respective electrode members exist nor toner intervenes between the respective electrode members. Thus, leakage via the boundary surface or the toner can be suppressed.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A developer bearer for conveying a developer to a developing station under an influence of an electric field created by an electric flux line, said developer bearer comprising:

an outer electrode and an inner electrode configured to receive voltages different from each other and collectively create the electric flux line, said outer electrode and said inner electrode being arranged on different layers in a normal line direction of the developer bearer, wherein the outer electrode is located at an outer side of the developer bearer and configured to include at least two electrode portions separated at a prescribed interval on a same circumference of the developer bearer, the inner electrode opposing at least two intervals between the at least two electrode portions of the outer electrode, and at least two electric fields are created side by side outside an outer circumferential surface of the developer bearer by a neighboring pair of the at least two electrode portions, said at least two electric fields having different intensities from each other; and an insulation layer sandwiched between the outer electrode and the inner electrode in the normal line direction and configured to insulate the outer electrode and the inner electrode.

2. The developer bearer as claimed in claim 1, wherein the inner electrode is located at an inner side of the developer bearer and has a prescribed thickness opposing both the at least two electrode portions and the at least two intervals between the at least two electrode portions.

3. The developer bearer as claimed in claim 2, wherein the inner electrode includes portions opposing the at least two intervals between the at least two electrode portions, arranged over a portion of the length of the inner electrode, and closer to the outer circumferential surface of the developer bearer than portions of the inner electrode opposing the at least two electrode portions.

4. A developing device, comprising:

an outer electrode and an inner electrode configured to receive voltages different from each other and collectively create an electric flux line, said outer electrode and said inner electrode being arranged at different layers in a normal line direction of a developer bearer, said outer electrode is located at an outer side of the developer bearer and configured to include at least two electrode portions separated at a prescribed interval on a same circumference of the developer bearer, the inner electrode is located at an inner side of the developer bearer opposing at least two intervals between the at least two electrode portions of the outer electrode;

an insulation layer sandwiched between the outer electrode and the inner electrode in the normal line direction and configured to insulate the outer electrode and the inner electrode; and at least one power distribution device configured to distribute different powers to the outer electrode and the inner electrode, respectively, wherein said at least one power distribution device distributes powers to form an electric field outside an outer circumferential surface of the developer bearer, said electric field causing a toner to hop on the outermost circumferential surface between one of the at least two electrode portions and one of the at least two intervals neighboring thereto, and said at least one power distribution device includes at least two power distribution devices configured to respectively distribute different powers to outer side electrodes arranged in at least two different regions around the developer bearer to form different electric fields.

5. The developer bearer as claimed in claim 1, wherein one of the at least two intervals between the at least two electrode portions is different from an other one of the at least two intervals.

6. The developer bearer as claimed in claim 5, wherein said one of the at least two intervals neighbors to the other one of the at least two intervals.

7. The developer bearer as claimed in claim 5, wherein said at least two electrode portions are made of a conductive material in a layer, and the at least two intervals are formed by dispersing insulation particles in the conductive material.

8. The developer bearer as claimed in claim 7, wherein an average particle diameter of the insulation particles is larger than a thickness of the conductive material.

9. The developer bearer as claimed in claim 5, wherein said at least two intervals are formed by an insulation material in a layer, and said at least two electrode portions are formed by dispersing conductive particles in the insulation material.

10. The developer bearer as claimed in claim 5, wherein said outer electrode includes a conductive foam material serving as an electrode portion; and an insulation material serving as an interval between electrode portions of the conductive foam, said insulation material being filled up in foam cells included in prescribed positions in the conductive foam material.

11. The developer bearer as claimed in claim 5, wherein said outer electrode includes an insulation foam material serving as the at least two intervals between the at least two electrode portions, and a conductive material serving as the at least two electrode portions, said conductive material being filled up in foam cells included in the insulation foam material.

12. The developer bearer as claimed in claim 5, wherein said at least two electrode portions are produced by spraying a conductive paste onto an insulation layer.

13. An developing device, comprising:

an outer electrode and an inner electrode configured to receive voltages different from each other and collectively create an electric flux line, said outer electrode and said inner electrode being arranged at different layers in a normal line direction of a developer bearer, said outer electrode is located at an outer side of the developer bearer and configured to include at least two electrode portions separated at a prescribed interval on a same circumference of the developer bearer, the inner electrode is located inside the outer electrode opposing at least two intervals between the at least two electrode portions of the outer electrode;

an insulation layer sandwiched between the outer electrode and the inner electrode in the normal line direction and configured to insulate the outer electrode and the inner electrode; and at least one power distribution device configured to distribute different powers to the outer electrode and the inner electrode, respectively, wherein said at least one power distribution device distributes powers to form an electric field outside an outer circumferential surface of the developer bearer, said electric field causing a toner to hop on the outermost circumferential surface between one of the at least two electrode portions and one of the at least two intervals neighboring thereto, and said at least one power distribution device includes at least two power distribution devices configured to respectively distribute different powers to outer side electrodes arranged in at least two different regions around the developer bearer to form different electric fields.

14. The developing device as claimed in claim 13, wherein a developing region of said at least two different regions includes a developing station for a developing, and an electric field formed in the developing station is more intensive than that formed in an other region of said at least two different regions.

15. The developing device as claimed in claim 14, further comprising:

a first power control device configured to change a power distributed to the outer side electrodes arranged in the developing region.

16. The developing device as claimed in claim 15, further comprising:

a second power control device configured to change a power distributed to the outer side electrodes arranged in regions other than the developing region.

17. The developing device as claimed in claim 13, further comprising:

a protection layer arranged on the outer electrode other than at both side ends of the developer bearer.

18. The developing device as claimed in claim 13, wherein power is distributed to one of the outer electrode and the inner electrode by plural routes.

19. A developer bearer for conveying a developer to a developing station under an influence of an electric field created by an electric flux line, said developer bearer comprising:

an outer electrode and an inner electrode configured to receive voltages different from each other and collectively create the electric flux line, said outer electrode and said inner electrode being arranged on different layers in a normal line direction of the developer bearer, wherein the outer electrode is located at an outer side of the developer bearer and configured to include at least two electrode portions separated at a prescribed interval on a same circumference of the developer bearer, the inner electrode is located at an inner side of the developer bearer, and the inner electrode includes portions opposing at least two intervals between the at least two electrode portions of the outer electrode, arranged over a portion of the length of the inner electrode, and closer to an outer circumferential surface of the developer bearer than portions of the inner electrode opposing the at least two electrode portions; and an insulation layer sandwiched between the outer electrode and the inner electrode in the normal line direction and configured to insulate the outer electrode and the inner electrode.

20. The developer bearer as claimed in claim 19, wherein the portions of the inner electrode opposing the at least two intervals between the at least two electrode portions are arranged over an entirety of the length of the inner electrode.

* * * * *